US011363893B2

(12) United States Patent
Thorne

(10) Patent No.: US 11,363,893 B2
(45) Date of Patent: Jun. 21, 2022

(54) FOLDABLE PLAY YARD

(71) Applicant: Henry F. Thorne, Sewickley, PA (US)

(72) Inventor: Henry F. Thorne, Sewickley, PA (US)

( * ) Notice: Subject to any disclaimer, the term of this patent is extended or adjusted under 35 U.S.C. 154(b) by 236 days.

(21) Appl. No.: 16/677,009

(22) Filed: Nov. 7, 2019

(65) Prior Publication Data

US 2020/0146465 A1 May 14, 2020

Related U.S. Application Data

(60) Provisional application No. 62/757,361, filed on Nov. 8, 2018.

(51) Int. Cl.
*A47D 13/06* (2006.01)

(52) U.S. Cl.
CPC ..... *A47D 13/063* (2013.01); *A47D 13/061* (2013.01)

(58) Field of Classification Search
CPC .. A47D 13/061; A47D 13/063; A47D 13/065; A47D 13/06; E04H 15/006; E04H 15/50; E04H 15/48
See application file for complete search history.

(56) References Cited

U.S. PATENT DOCUMENTS 1,853,367 A * 4/1932 Mace ..... E04H 15/48 135/123
4,811,437 A 3/1989 Dillner et al.
6,079,063 A 6/2000 Cheng
6,089,247 A * 7/2000 Price ..... E04H 15/48 135/145
6,256,814 B1 7/2001 Drobinski
6,336,234 B1 7/2002 Kuo
6,623,079 B2 9/2003 Gregory
6,948,197 B1 9/2005 Chen
7,458,115 B2 12/2008 Chen et al.
(Continued)

FOREIGN PATENT DOCUMENTS

CN 101305878 A * 11/2008 ..... A47D 13/063
CN 203735845 U * 7/2014 ..... A47D 13/063
(Continued)

OTHER PUBLICATIONS

Information Disclosure Statement form filed in U.S. Appl. No. 13/610,998, filed May 6, 2013.
(Continued)

*Primary Examiner* — Michael Safavi
(74) *Attorney, Agent, or Firm* — David G. Oberdick; Chiara F. Orsini

(57) ABSTRACT

A foldable play yard includes a plurality of corner posts; a plurality of top rails, each of the top rails rotatably connected to two of the plurality of corner posts to define a polygonal shape; a plurality of reversing links, each of the plurality of reversing links rotatably connected to one of the plurality of corner posts; a central hub; a plurality of lower linkage assemblies, each of the lower linkage assemblies rotatably connected to one of the plurality of reversing links and rotatably connected to the central hub; and a plurality of post linkage assemblies, each of the post linkage assemblies rotatably connected to one of more of the top rails and rotatably connected to one of the reversing links. Lowering the central hub causes each of the lower linkage assemblies to rotate relative to the corner posts in a first direction.

10 Claims, 17 Drawing Sheets

(56) References Cited

U.S. PATENT DOCUMENTS

| | | | | |
|---|---|---|---|---|
| 7,581,269 | B2 | 9/2009 | Chen et al. | |
| 7,661,156 | B2 | 2/2010 | Thorne et al. | |
| 7,752,688 | B2 | 7/2010 | Chen et al. | |
| 7,770,245 | B2 | 8/2010 | Cheng et al. | |
| 7,836,530 | B2 | 11/2010 | Thorne et al. | |
| 7,930,776 | B2 | 4/2011 | Chen et al. | |
| 7,950,081 | B2 | 5/2011 | Chen et al. | |
| 7,958,578 | B2 | 6/2011 | Shan et al. | |
| 8,006,326 | B2 | 8/2011 | Thomas et al. | |
| 8,060,959 | B2 | 11/2011 | Thorne et al. | |
| 8,458,829 | B2 | 6/2013 | Thorne et al. | |
| D688,115 | S | 8/2013 | Wiegmann et al. | |
| 8,650,678 | B2 | 2/2014 | Thorne et al. | |
| 8,739,331 | B2 | 6/2014 | Gillett et al. | |
| 8,756,727 | B2 | 6/2014 | Thorne et al. | |
| 8,806,674 | B2 | 8/2014 | Thorne et al. | |
| 8,955,175 | B2 | 2/2015 | Wiegmann et al. | |
| 8,973,181 | B2 | 3/2015 | Thorne et al. | |
| 9,060,621 | B2 | 6/2015 | Thorne et al. | |
| 9,301,624 | B2 | 4/2016 | Rosenthal et al. | |
| 9,345,339 | B2 | 5/2016 | Wang et al. | |
| 9,756,964 | B2 * | 9/2017 | Yang | A47D 9/005 |
| 9,770,118 | B2 | 9/2017 | Mountz | |
| 10,694,865 | B2 * | 6/2020 | Yang | F16B 7/14 |
| 10,980,356 | B2 * | 4/2021 | Zhang | B68G 5/00 |
| 2006/0021137 | A1 * | 2/2006 | Waldman | A47D 13/063 5/99.1 |
| 2006/0225204 | A1 | 10/2006 | Bretschger et al. | |
| 2007/0017025 | A1 | 1/2007 | Myer | |
| 2008/0034497 | A1 | 2/2008 | Cheng | |
| 2008/0189854 | A1 | 8/2008 | Thorne et al. | |
| 2008/0196163 | A1 | 8/2008 | Thorne et al. | |
| 2009/0013463 | A1 | 1/2009 | Cheng | |
| 2009/0172879 | A1 | 7/2009 | Hus | |
| 2011/0031457 | A1 | 2/2011 | Thorne et al. | |
| 2012/0012801 | A1 * | 1/2012 | Burns | A47D 13/063 256/25 |
| 2012/0248394 | A1 | 10/2012 | Thorne et al. | |
| 2012/0266381 | A1 | 10/2012 | Thorne et al. | |
| 2013/0239322 | A1 | 9/2013 | Thorne et al. | |
| 2013/0240815 | A1 | 9/2013 | Wiegmann et al. | |
| 2014/0041116 | A1 | 2/2014 | Rosenthal et al. | |
| 2014/0123385 | A1 | 5/2014 | Thorne et al. | |
| 2014/0165288 | A1 | 6/2014 | Wang et al. | |
| 2021/0007509 | A1 * | 1/2021 | Mountz | A47D 13/063 |

FOREIGN PATENT DOCUMENTS

| | | | | |
|---|---|---|---|---|
| GB | 117199 | A * | 7/1918 | E04B 1/3441 |
| KR | 10-1992-0007466 | B1 | 9/1992 | |
| WO | WO-2008120071 | A2 * | 10/2008 | E04H 15/505 |
| WO | WO-2016058505 | A1 * | 4/2016 | A47D 9/005 |
| WO | WO-2018206893 | A1 * | 11/2018 | E04H 15/48 |
| WO | WO-2020143623 | A1 * | 7/2020 | A47D 13/06 |

OTHER PUBLICATIONS

Information Disclosure Statement form filed in U.S. Appl. No. 13/960,101, filed Aug. 9, 2013.

Information Disclosure Statement form filed in U.S. Appl. No. 13/960,101, filed Oct. 26, 2015.

Information Disclosure Statement form filed in U.S. Appl. No. 14/333,101, filed Aug. 11, 2014.

Information Disclosure Statement form filed in U.S. Appl. No. 14/152,031, filed Jan. 23, 2014.

Information Disclosure Statement form filed in U.S. Appl. No. 13/891,329, filed Aug. 7, 2013.

Information Disclosure Statement form filed in U.S. Appl. No. 13/432,165, filed Jul. 9, 2012.

Information Disclosure Statement form filed in U.S. Appl. No. 13/432,165, filed Nov. 21, 2012.

Information Disclosure Statement form filed in U.S. Appl. No. 12/906,605, filed May 5, 2011.

Information Disclosure Statement form filed in U.S. Appl. No. 11/675,098, filed Jul. 10, 2008.

Information Disclosure Statement form filed in U.S. Appl. No. 11/675,098, filed Dec. 16, 2008.

* cited by examiner

FOLDABLE PLAY YARD

CROSS-REFERENCE TO RELATED APPLICATIONS

This application claims priority to U.S. Provisional Application Ser. No. 62/757,361, filed Nov. 8, 2018, which application is incorporated by reference herein in its entirety.

BACKGROUND OF INVENTION

Field of the Invention

The present invention is generally directed to a child play yard and, more particularly, a child play yard that is foldable into a compact position when not in use.

Description of Related Art

Foldable play yards, playpens, and crib devices are well known, as exemplified, by U.S. Pat. No. 4,811,437 for a "Foldable Playyard" to Dillner et al. The foldable device disclosed therein is light in weight and, when collapsed, a fairly convenient compact package. One major problem with such devices, however, is that they are difficult to handle because they are cumbersome to open and unwieldy to fold with clumsy operating mechanisms. Usually there is a need to pull up on a central lower mechanism and a need to unlatch upper rails also. Another device is shown in U.S. Patent Application Publication No. 2007/0017025, for a "Folding Play Yard" to Myer. There is a purported disclosure of a release mechanism that causes release means such as a cable to unlatch upper side members so that the play yard may go from a deployed to a folded condition. However, there is no disclosure concerning the movement of the play yard from the folded condition to a deployed condition. The release means plays no part in such a movement. Furthermore, the lower structure of the disclosed play yard includes diagonal braces, as well as side members, so that the play yard is complicated and heavy.

Many known play yard designs require complex interconnections of linkages, cables, and/or gear assemblies to obtain the desired qualities of easy operation and compact folding. However, such designs are often expensive to manufacture and require significant calibration during assembly to ensure the play yard folds correctly.

In view of these deficiencies, there exists a need for a play yard that is lightweight and robust while also being easy to operate and efficient to manufacture.

SUMMARY OF THE INVENTION

Some embodiments of the present invention are directed to a foldable play yard that has a plurality of corner posts and a plurality of top rails, each top rail having two opposing ends, and each of the opposing ends of each of the plurality of top rails rotatably connected to one of the plurality of corner posts to define a polygonal shape. The folding play yard of this embodiment also has a plurality of reversing links with each reversing link having a first, second and third connection point, and each of the plurality of reversing links rotatably connected at the second connection point of each of the reversing link to a corresponding one of the plurality of corner posts. The play yard also has a central hub, the moves up and down to aid in opening and closing the play yard. This embodiment of a play yard also has a plurality of lower linkage assemblies, corresponding to the reversing links, with each lower linkage assembly having a first and second end, and each of the plurality of lower linkage assemblies rotatably connected at the first end of each lower linkage assembly to the third connection point of a corresponding reversing link and, at the second end of each lower linkage assembly rotatably connected to the central hub. Additionally, the play yard has a plurality of post linkage assemblies corresponding to the reversing links, with each post linkage assembly having a first and second end, and each of the plurality of post linkage assemblies rotatably connected at the first end of each post linkage assembly to one or more of the top rails and, at the second end of each post linkage assembly, rotatably connected to the first connection point of an associated or corresponding reversing link. Lowering the central hub of a play yard according to the present invention causes each of the lower linkage assemblies to rotate relative to a corresponding corner post in a first direction, which rotation of each of the lower linkage assemblies in the first direction causes each of the reversing links to rotate relative to a corresponding corner post in a second direction opposite the first direction, and then the rotation of the reversing links in the second direction drives the post linkage assemblies to rotate the top rails relative to the corresponding corner posts.

In some embodiments, each of the lower linkage assemblies includes a top diagonal link rotatably connected to the central hub and rotatably connected to one of the plurality of corner posts, and a lower diagonal link rotatably connected to the central hub and rotatably connected to one of the plurality of reversing links.

In some embodiments, each of the top diagonal links is rotatably connected to the corner post at the same pivot point as one of the reversing links.

In some embodiments, each of the post linkage assemblies includes a locking link rotatably connected to one or more of the top rails, an actuating link rotatably connected to the locking link, and a lifting link rotatably connected to the actuating link and rotatably connected to one of the reversing links.

In some embodiments, the foldable play yard further includes an anti-racking link rotatably connected to one of the lower linkage assemblies and rotatably connected to one of the post linkage assemblies. The anti-racking link limits rotation of the reversing links.

In some embodiments, the foldable play yard further includes an anti-racking link rotatably connected to the lower diagonal link of one of the lower linkage assemblies and rotatably connected to one of the post linkage assemblies. The anti-racking link limits rotation of the reversing links.

In some embodiments, the foldable play yard further includes an anti-racking link rotatably connected to one of the lower linkage assemblies and rotatably connected to the lifting link of one of the post linkage assemblies. The anti-racking link limits rotation of the reversing links.

In some embodiments, the foldable play yard further includes a guide roller rotatably connected to the actuating link of each post linkage assembly and configured to roll along a guide pad of each of the corner posts. The guide pad of each of the corner posts includes a slanted top surface configured to lock the guide roller in place when the guide roller passes over the slanted top surface.

Other embodiments of the present disclosure are directed to a folding mechanism for a foldable play yard, the foldable play yard including a plurality of corner posts and a plurality of top rails, each of the top rails rotatably connected to two of the plurality of corner posts to define a polygonal shape.

The folding mechanism includes a central hub, a reversing link rotatably connected to the central hub via a lower linkage assembly, the reversing link rotatably connected to one of the corner posts, and a post linkage assembly rotatably connected to the reversing link and rotatably connected to at least one of the top rails. Lowering the central hub causes the reversing link to rotate. Rotation of the reversing link causes the post linkage assembly to rotate at least one of the top rails.

In some embodiments, the folding mechanism further includes an anti-racking link rotatably connected to the lower linkage assembly and rotatably connected to the post linkage assembly. The anti-racking link limits rotation of the reversing link.

In some embodiments, the lower linkage assembly includes a top diagonal link rotatably connected to the central hub and rotatably connected to one of the plurality of corner posts, and a lower diagonal link rotatably connected to the central hub and rotatably connected to the reversing link.

In some embodiments, lowering the central hub causes the reversing link to rotate in a direction opposite rotation of the lower linkage assembly.

Other embodiments of the present disclosure are directed to locking mechanism for a foldable play yard, the foldable play yard including a plurality of corner posts and a plurality of top rails, each of the top rails rotatably connected to two of the plurality of corner posts to define a polygonal shape. The locking mechanism includes an actuating link slidably connected to one of the corner posts, a locking link rotatably connected to the actuating link and rotatably connected to one of the top rails, a guide roller rotatably connected to the actuating link, and a guide pad connected to one of the corner posts, the guide pad including a slanted top surface. The guide roller is configured to roll along the guide pad as the actuating link slides relative to the corresponding corner post. The top slanted surface of the guide pad is configured to lock the guide roller in place when the guide roller passes over the slanted top surface.

These and other features and characteristics of the present disclosure, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

BRIEF DESCRIPTION OF THE DRAWINGS

For the purpose of facilitating understanding of the invention, the accompanying drawings and description illustrate preferred embodiments thereof, from which the invention, various embodiments of its structures, construction and method of operation, and many advantages, may be understood and appreciated.

DETAILED DESCRIPTION OF THE INVENTION

For purposes of the description hereinafter, the terms "upper", "lower", "right", "left", "vertical", "horizontal", "top", "bottom", "lateral", "longitudinal", and derivatives thereof shall relate to the invention as it is oriented in the figures. However, it is to be understood that the invention may assume alternative variations and step sequences, except where expressly specified to the contrary. It is also to be understood that the specific devices and processes illustrated in the attached drawings and described in the following specification are simply exemplary embodiments of the invention. Hence, specific dimensions and other physical characteristics related to the embodiments disclosed herein are not to be considered as limiting.

As used herein, the term "substantially", when used in the context of defining a first angle relative to a second angle, means that the first angle is within about 5°, and typically no greater than 6°, of the second angle. For example, the term "substantially perpendicular to" means "within about 5° of perpendicular to" or "between about 85° and 95° relative to". Similarly, the term "substantially parallel to" means "within about 5° of parallel to" or "between about −5° and 5° relative to". Such definitions are consistent with the commonly-accepted movement of parts of play yards as represented by U.S. Pat. No. 8,756,727 for a Foldable Child Enclosure to Thorne et al. and its related patents and patent applications.

As used herein, the term "pivot", when used as a noun, means a structural and functional connection between at least two components which allows at least partial rotation of the at least two components relative to one another. For example, a pivot between a first link and a second link means a physical connection between the first link and the second link that permits at least partial rotation of the first link relative to the second link, and vice versa. The pivot may include a hole in one or both of the first and second links, and an axial member extending through the hole(s) to constrain the first and second links to each other about a rotational axis. The axial member may include a pin, bolt, screw, bearing, bushing, or combination thereof to facilitate rotation of the first and second links relative to each other.

Embodiments of the present disclosure are generally directed to a child play yard and, more particularly, a child play yard that is foldable into a compact position when not in use.

Figure 1:
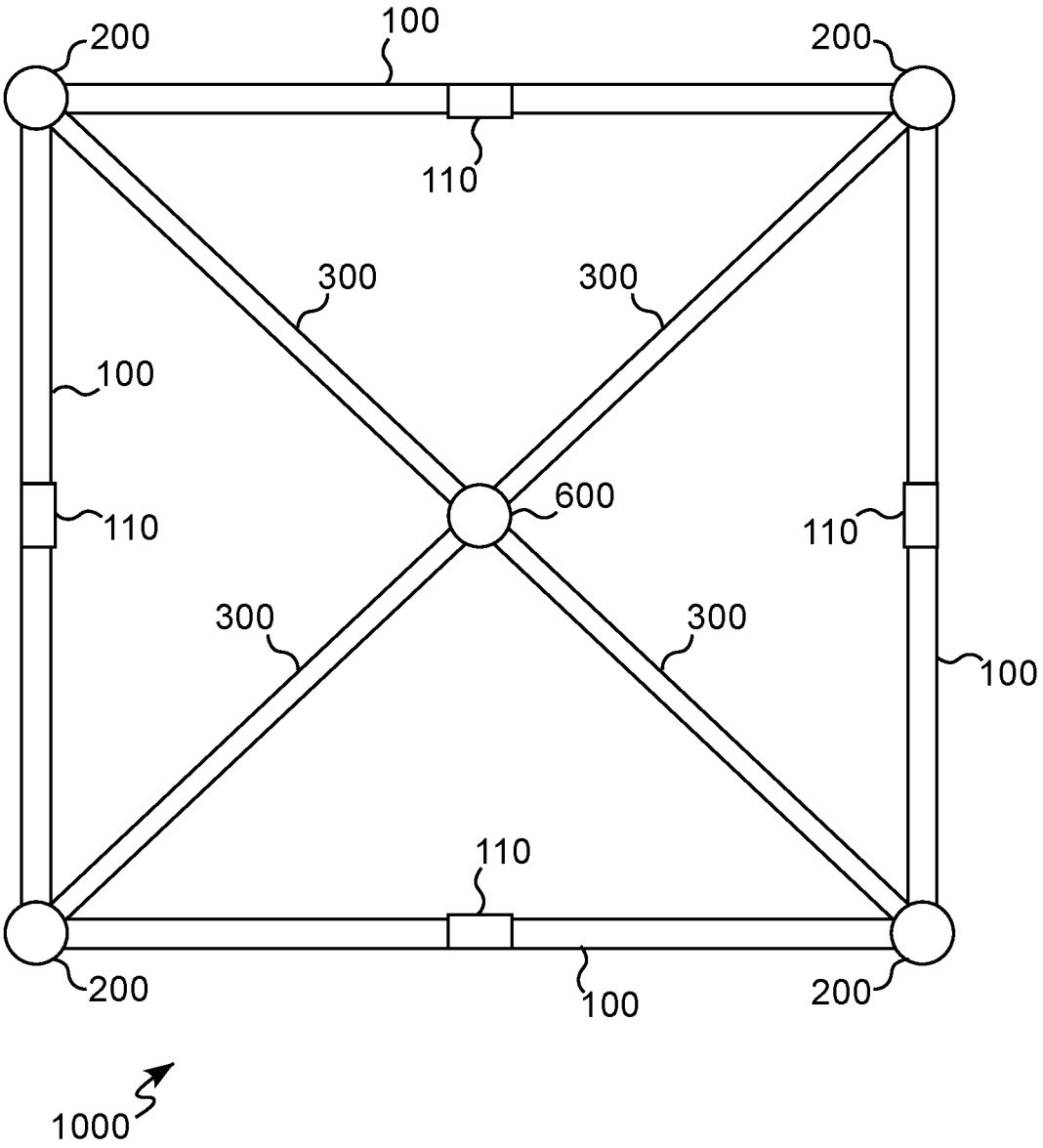
FIG. 1 is a top schematic view of a play yard, shown in an unfolded position, according to an embodiment of the present disclosure.

FIG. 1 shows a top schematic view of a play yard 1000 according to one embodiment of the present invention. The play yard 1000 is shown in an unfolded position, ready for use. The play yard 1000 includes a plurality of top rails 100 connected to a plurality of corner posts 200 to define a polygonal shape, such as a rectangle as shown. The top rails 100 are connected to upper ends of the corner posts 200, with each of the corner posts 200 connected to two of the top rails 100. Each top rail 100 includes a joint member 110 which allows the top rail 100 to fold such that the pair of corner posts 200 connected to the top rail 100 are brought toward each other.

With continued reference to FIG. 1, a lower end of each of the corner posts 200 is connected to one of a plurality of lower linkage assemblies 300. Each of the lower linkage assemblies 300 is connected to a central hub 600, located substantially equidistant from each of the corner posts 200. The plurality of lower linkage assemblies 300, corresponding to the reversing links, are pivotally connected to the corner posts 200 and the central hub 600 such that the corner posts 200 may be drawn together by rotation of the lower linkage assemblies 300.

Figure 2:
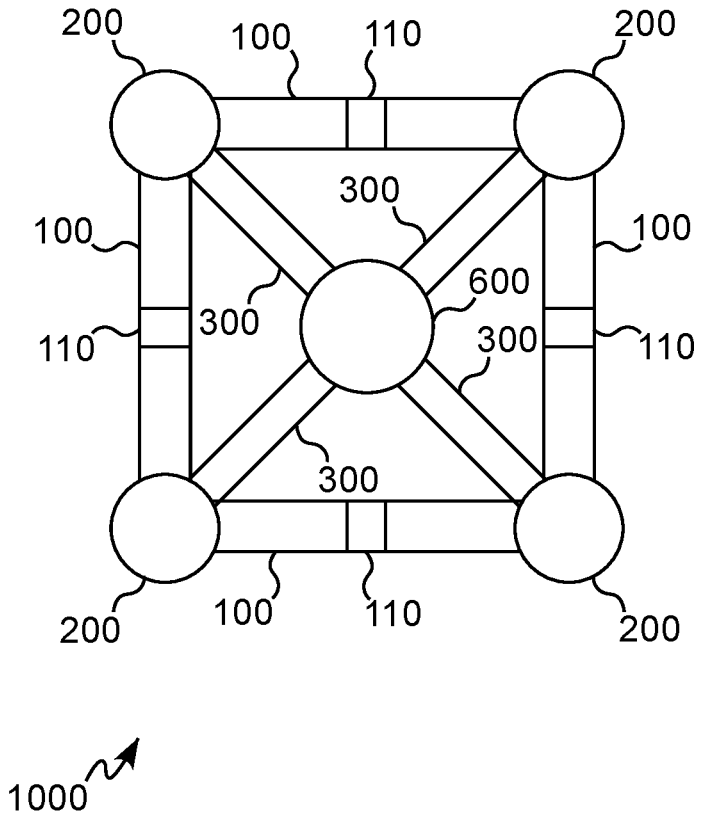
FIG. 2 is a top schematic view of the play yard of FIG. 1, shown in a folded position.

While FIGS. 1 and 2 show the play yard 1000 having four sides, one side corresponding to each of the top rails 100, the play yard 1000 may have more or fewer sides without departing from the scope of the invention. Generally, the number of sides of the play yard 1000 will be equal to the number of top rails 100 and equal to the number of lower linkage assemblies 300. For example, a three-sided or triangular play yard 1000 may have three top rails 100 and three lower linkage assemblies 300, a five-sided or pentagonal play yard 1000 may have five top rails 100 and five lower linkage assemblies 300, and a six-sided or hexagonal play yard 1000 may have six top rails 100 and six lower linkage assemblies 300. Moreover, while FIGS. 1 and 2 show a square play yard 1000 with sides of equal length, other embodiments of the play yard 1000 may have sides of different lengths.

To transition the play yard 1000 from the unfolded position shown in FIG. 1 to the folded position shown in FIG. 2 for storage, a user may raise the central hub 600 thereby decreasing the angle between each of the lower linkage assemblies 300 and the connected corner posts 200. The lower linkage assemblies 300 are operatively connected to the top rails 100 such that each the top rails 100 folds at the joint member 110 as the central hub 600 is raised. As such, raising the central hub 600 causes the corner posts 200 to be drawn together toward each other and toward the central hub 600, as shown in FIG. 2. To transition the play yard 1000 from the folded position to the unfolded position, the central hub 600 is lowered, causing the lower linkage assemblies 300 to rotate away from the corner posts 200 and the top rails 100 to unfold.

Not depicted in FIGS. 1 and 2, for clarity, are the sidewalls and floor of the play yard 1000, which may be made of fabric, mesh, and/or similar pliable materials. Additionally, the top rails 100, corner posts 200, and lower linkage assemblies 300 are shown schematically as single, monolithic elements. However, each of the top rails 100, the corner posts 200, and the lower linkage assemblies 300 may include one or more interconnected members, as shown in greater detail with reference to FIGS. 3 through 17. Also in FIGS. 1 and 2, the corner posts 200 are generally depicted as extending substantially parallel to a vertical axis and substantially parallel to one another, for simplicity. However, as will become apparent from FIGS. 3-17, the corner posts 200 may each be inclined inwardly or outwardly relative to the vertical axis and the central hub 600 while remaining substantially parallel. Furthermore, the corner posts 200 may change inclination with respect to the vertical axis as the play yard 1000 is transitioned from the unfolded position to the folded position, and vice versa.

Transitioning of the play yard 1000 between the unfolded and folded positions will now be described in greater detail with reference to FIGS. 3 through 17, which for simplicity show only one side of the play yard 1000.

Figure 3:
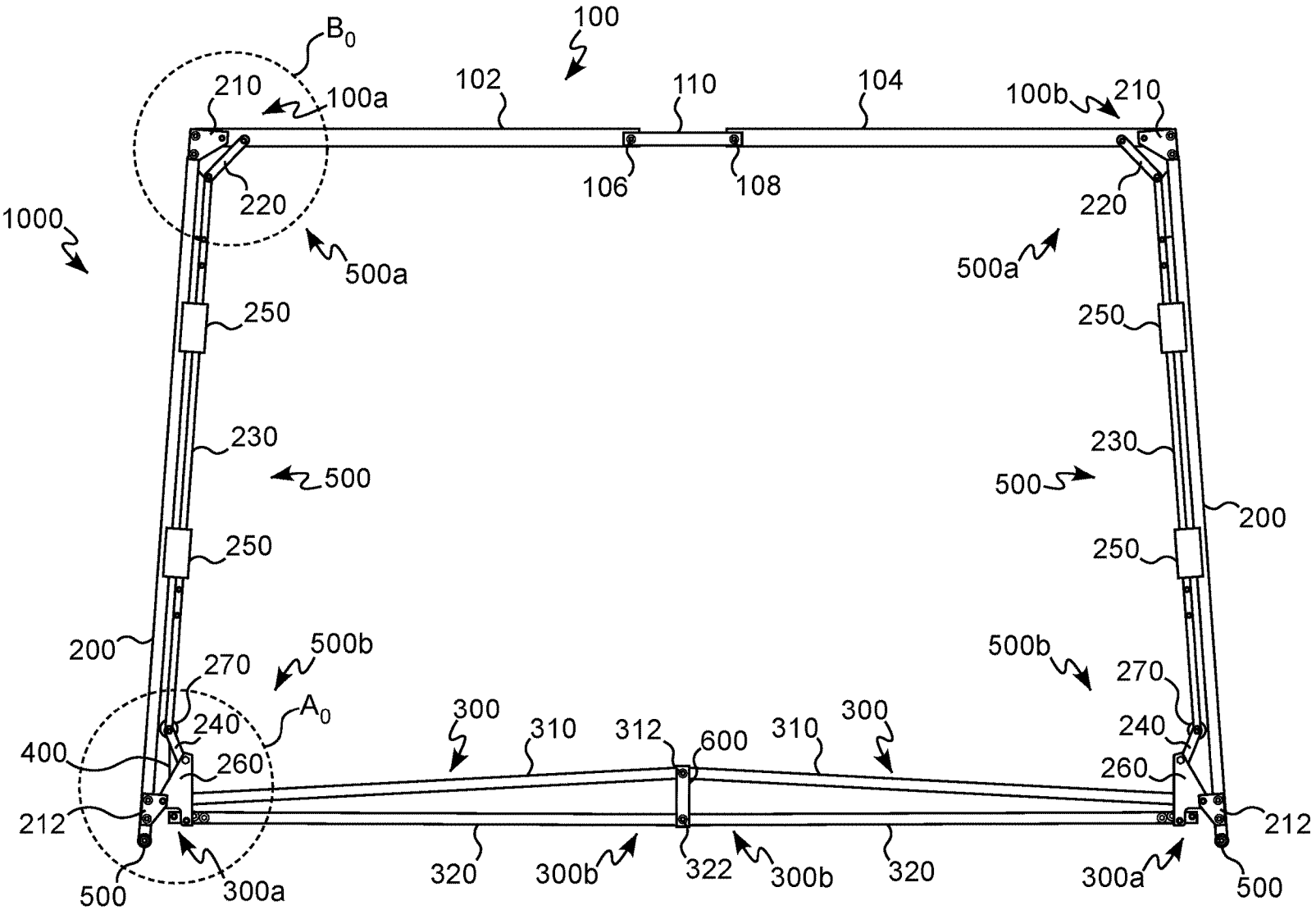
FIG. 3 is a side view of a play yard according to an embodiment of the present invention, in the unfolded position.

Referring now to FIG. 3, one side of the play yard 1000 is shown in the unfolded state with the top rail 100, having two opposing ends 100*a* and 100*b*, substantially straight across and the joint member 110 in an extended position. The top rail may include a left member 102 and a right member 104 rotatably connected to the joint member 110 at respective pivot points 106, 108. In some embodiments, the left and right members 102, 104 of the top rail 100 may be rotatably connected directly to each other, with the joint member 110 omitted. However, inclusion of the joint member 110 having two pivot points 106, 108 corresponding to the left and right members 102, 104 provides a safety feature in that the joint member 110 can bend in a compound manner to deflect around a user's or child's body part located underneath the joint member 110. As such, the risk of crushing or trapping the user's or child's body part is reduced by the presence of the joint member 110.

Figure 4:
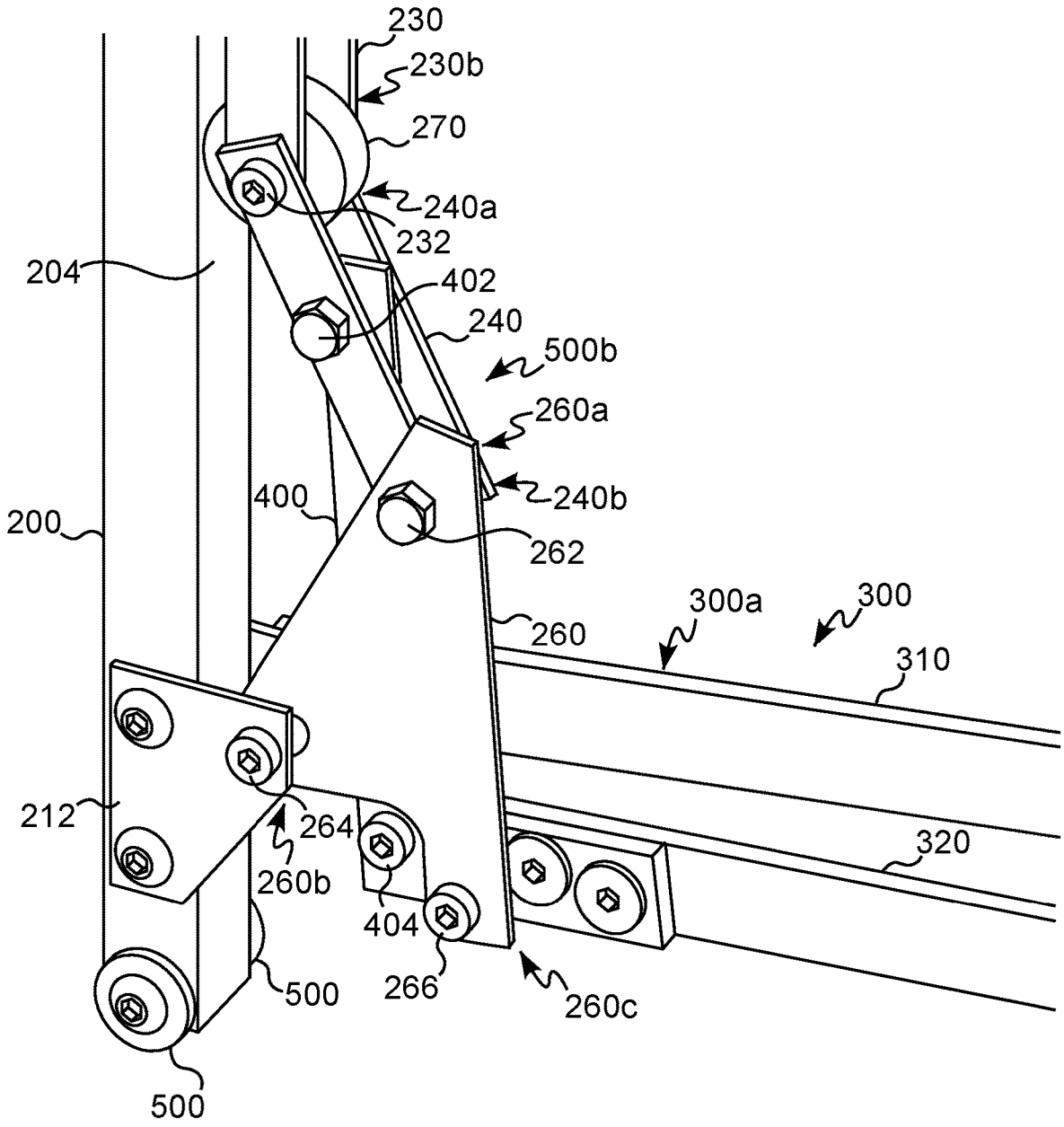
FIG. 4 is a perspective view of detail $A_0$ of FIG. 3, showing a foot of the play yard in the unfolded position.
Figure 5:
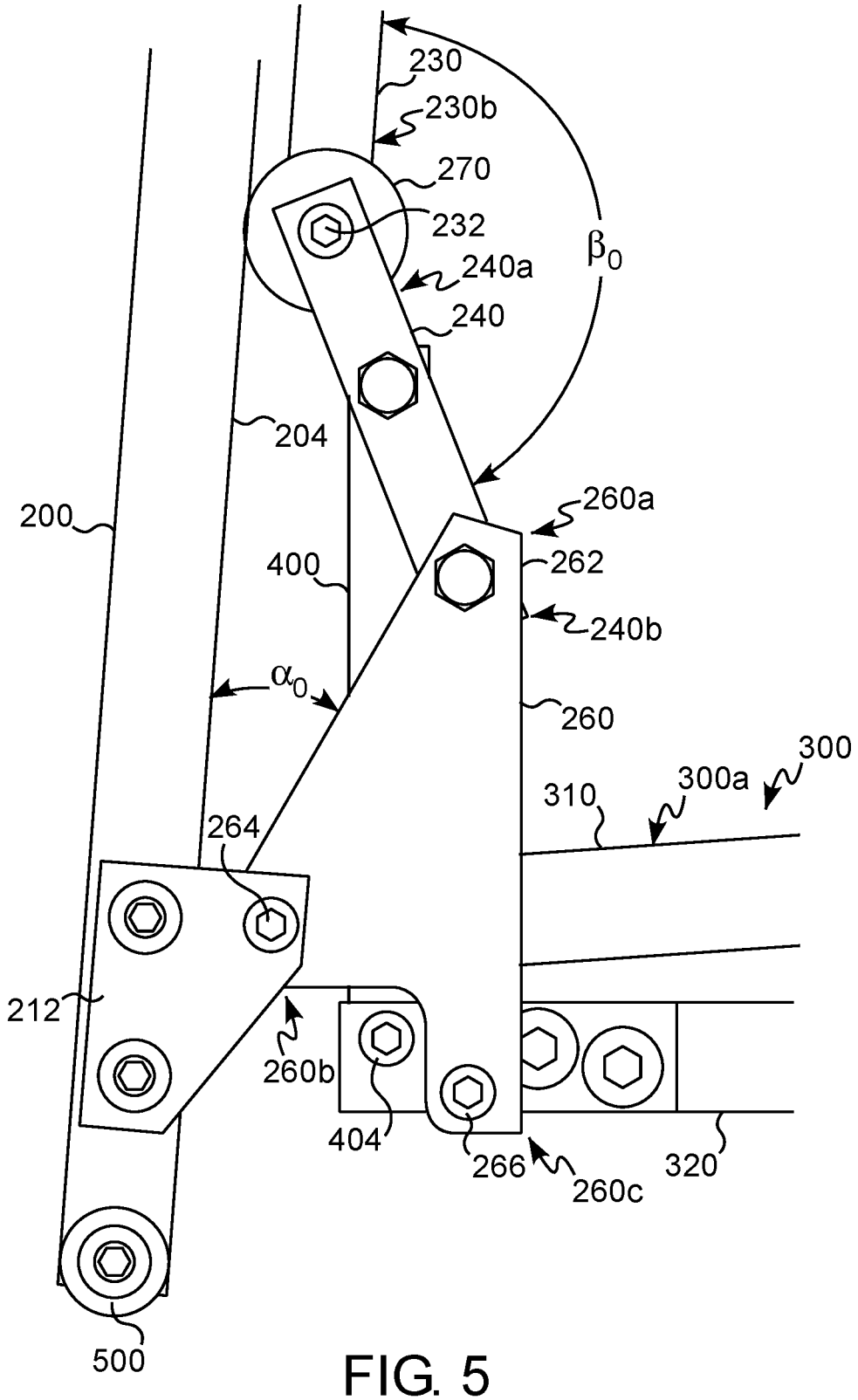
FIG. 5 is a side view of detail $A_0$ of FIG. 3.
Figure 6:
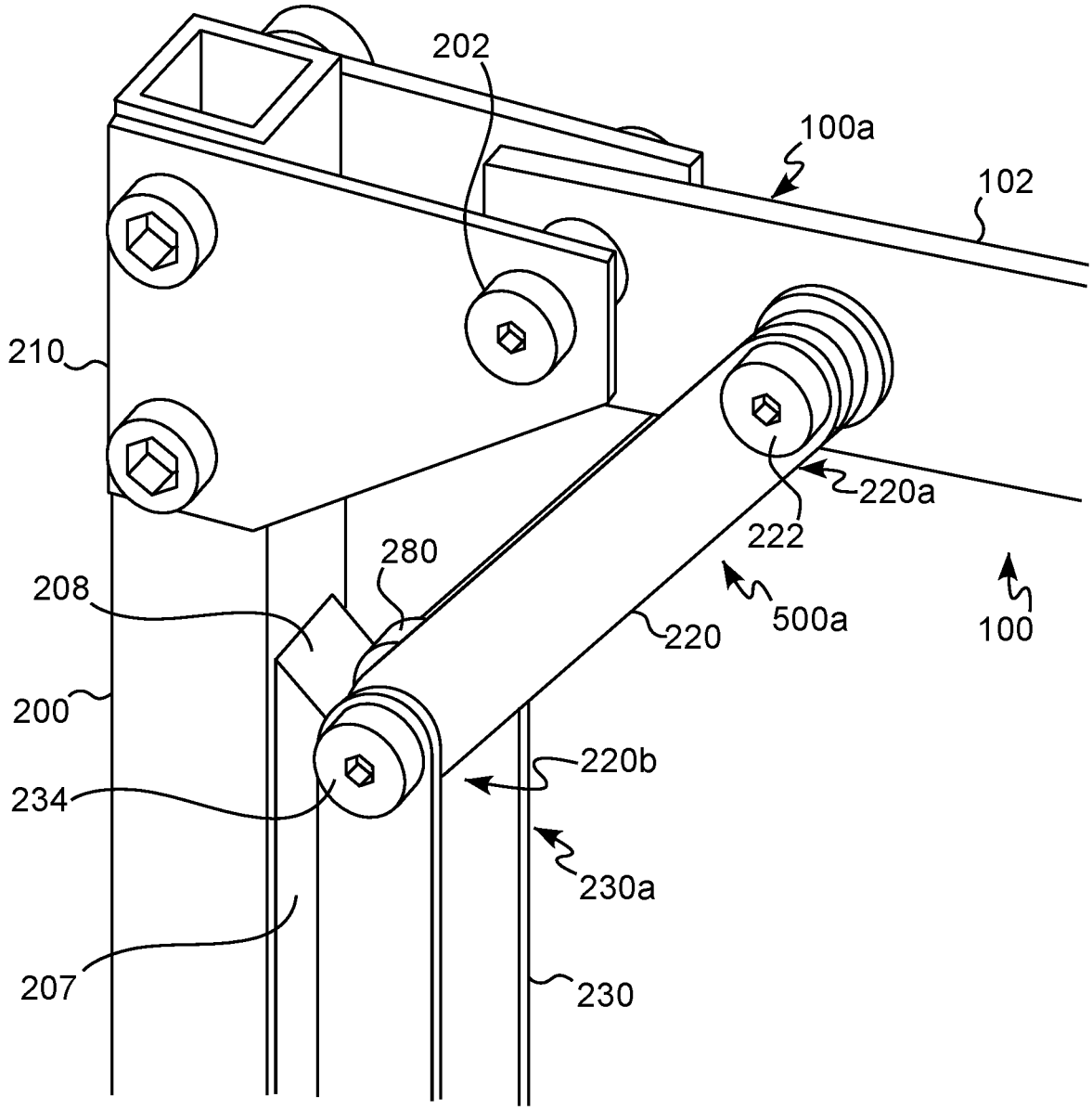
FIG. 6 is a perspective view of detail $B_0$ of FIG. 3, showing an upper corner of the play yard in the unfolded position.
Figure 7:
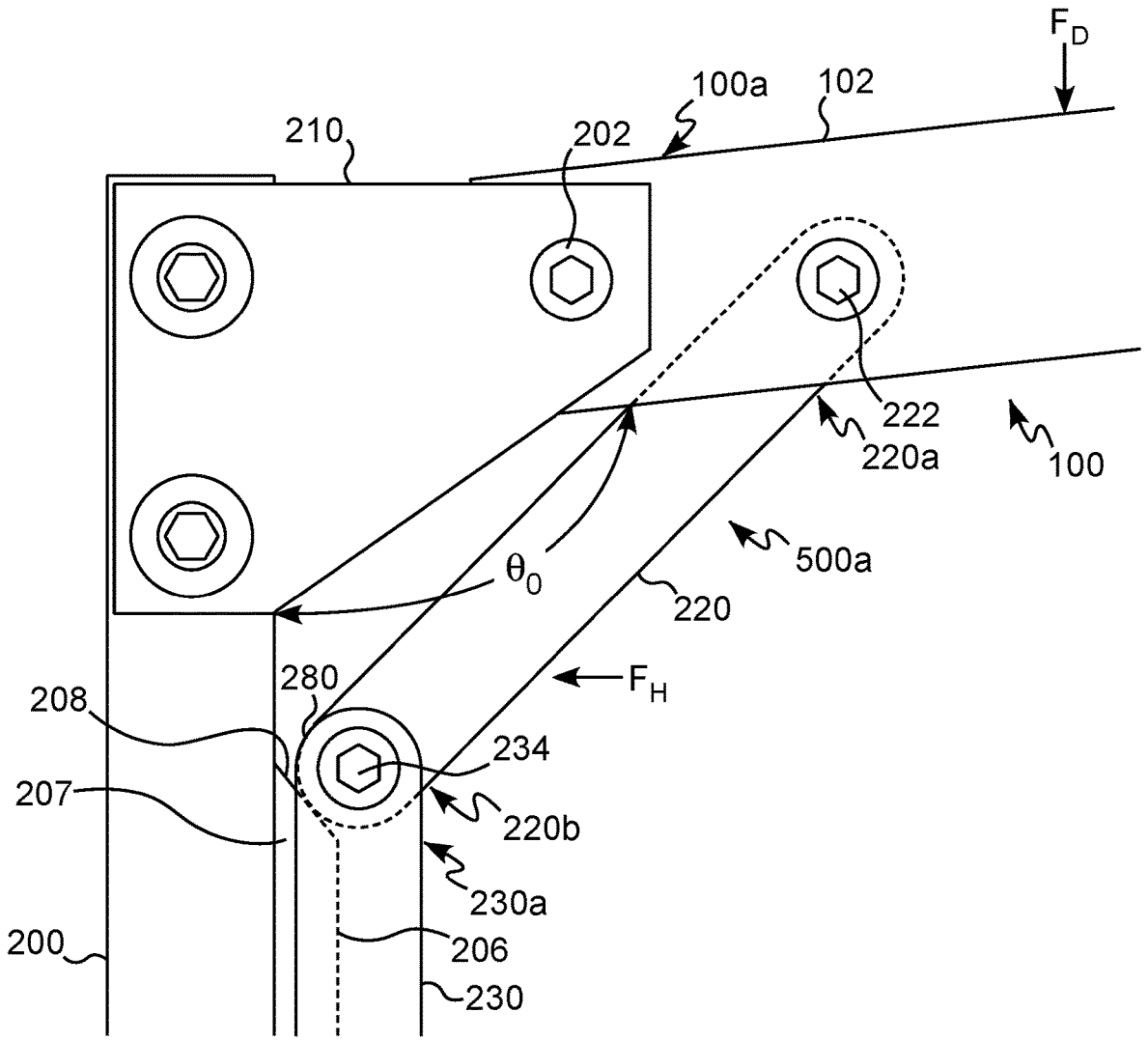
FIG. 7 is a side view of detail $B_0$ of FIG. 3.

As shown in detail in FIG. 6, the opposing ends 100*a* and 100*b* of the left and right members 102, 104 of the top rail 100 opposite the joint member 110 are rotatably connected to opposing corner posts 200 at upper corner pivots 202. Each upper corner pivot 202 may be located on an upper corner bracket 210 extending from the corner post 200 and offsetting the upper corner pivot 202 from the longitudinal axis of the corner post 200. Each of the left and right members 102, 104 of the top rail 100 are also rotatably connected to a first end of a locking link 220. Each locking link 220 has a first end 220*a* and a second end 220*b* and is rotatable relative to the corresponding left or right member 102, 104 of the top rail 100 about a locking link pivot 222 located along the corresponding left or right member 102, 104 between the upper corner pivot 202 and the joint 110. The second end 220*b* of each locking link 220 opposite the connection to the top rail 100 is connected to a first end 230*a* of an actuating link 230 generally extending along or beside the corner post 200 (as shown in FIGS. 3 through 8). As shown in FIGS. 6 and 7, the locking link 220 and the actuating link 230 are connected to each other at an upper actuating link pivot 234 that permits rotation of the locking link 220 relative to the actuating link 230. As shown in FIGS. 4 and 5, a second end 230*b* of the actuating link 230 opposite the connection to the locking link 220 is connected to a first end 240*a* of a lifting link 240. The actuating link 230 and the lifting link 240 are connected to each other at a lower actuating link pivot 232 that permits rotation of the lifting link 240 relative to the actuating link 230. Collectively, the locking link 220, the actuating link 230, and the lifting link 240 may hereinafter be referred to as the post linkage assembly 500.

Each corner post 200 may include one or more guide channels 250 extending around the actuating link 230 to limit or prevent movement of the actuating link 230 in a direction perpendicular to the longitudinal axis of the corner post 200. The one or more guide channels 250 permit translation or sliding of the actuating link 230 in a direction generally parallel to the longitudinal axis of the corner post 200. As such, the locations of the upper and lower actuating link pivots 234, 232 relative to the corner post 200 may be changed by sliding the actuating link 230 generally parallel to the longitudinal axis of the corner post 200. In some embodiments of the present disclosure, the one or more guide channels 250 may extend from the corner post 200, as is shown in the accompanying drawings. In other embodiments of the present disclosure, the one or more guide channels 250 may be defined by a cavity in a cover or shroud surrounding the corner post 200.

As shown in FIGS. 4 and 5, a second end 240*b* of the lifting link 240 opposite the connection to the actuating link 230 is rotatably connected to a reversing link 260. The reversing link 260 has a first connection point 260*a*, a second connection point 260*b* and a third connection point 260*c*. The second end 240*b* of the lifting link 240 is rotatably connected to the first connection point 260*a* of an associated or corresponding reversing link 260, which connection, in some embodiments, is a lifting link pivot 262. An associated reversing link 260 is also rotatable connected to the corresponding corner post 200 at the second connection point 260*b* of the reversing link 260 and is rotatably connected to the lower linkage assembly 300 at the third connection point 260*c* of the reversing link 260. The reversing link 260 is connected to the corner post 200 at a reversing link pivot 264 which may be located on a lower corner bracket 212 to offset the reversing link pivot 264 from the longitudinal axis of the corner post 200. The reversing link 260 is further connected to the lower linkage assembly 300 at two locations.

Each lower linkage assembly 300 will have a first end 300*a* where the lower linkage assembly 300 connects to a corresponding corner post 200 and a second end 300*b* where the lower linkage assembly 300 connects to the central hub 600. As may be appreciated from FIG. 3, for some embodiments of the present invention the lower linkage assembly 300 may include an upper diagonal link 310 and a lower diagonal link 320. The upper diagonal link 310 may be connected to the reversing link 260 and the corner post 200 at the reversing link pivot 264 such that the reversing link 260 and the lower diagonal link 320 may rotate relative to each other and relative to the corresponding corner post 200. The lower diagonal link 320 may be connected to the reversing link 260 at a lower link pivot 266 such that the lower diagonal link 320 may rotate relative to the corresponding reversing link 260. An end of the upper diagonal link 310 opposite the connection to the reversing link 260 and the corner post 200 is rotatably connected to the central hub 600 at an upper hub pivot 312. Similarly, the lower diagonal link 320 opposite the connection to the reversing link 260 is rotatably connected to the central hub 600 at a lower hub pivot 322.

Referring now to FIGS. 4 and 5, the foot portion of the play yard 1000 shown in detail $A_0$ of FIG. 3 will now be described in greater detail. The actuating link 230 may include a lower guide roller 270 rotatably connected to the actuating link 230 and configured to roll along a lower bearing surface 204 of the corner post 200 as the actuating link 230 is slid relative to the corresponding corner post 200. As shown in FIGS. 4 and 5, the lower guide roller 270 may be connected to the actuating link 230 at the lower actuating link pivot 232, such that the lower actuating link pivot 232 serves as both the connection between the actuating link 230 and the lifting link 240 and as a rotational axis of the lower guide roller 270. In other embodiments of the present disclosure, the lower guide roller 270 may be connected at any location along the actuating link 230 on either side of the lower actuating link pivot 234.

With continued reference to FIGS. 4 and 5 some embodiments of the present disclosure may optionally include an anti-racking link 400 connecting the lifting link 240 to the lower linkage assembly 300. The anti-racking link 400 has a first end rotatably connected to the lifting link 240 at an upper anti-racking pivot 402. Further, the anti-racking link 400 has a second end rotatably connected to the lower diagonal link 320 of the lower linkage assembly 300 at a lower anti-racking pivot 404. The upper anti-racking pivot 402 may be located along the lifting link 240 between the lower actuating link pivot 234 and the lifting link pivot 262. The lower anti-racking pivot 404 may be located on lower diagonal link 320 of the lower linkage assembly 300 at a location between the lower link pivot 266 and the corner post 200. The function of the anti-racking link 400 is to control movement of the lower assembly 300 relative to the lifting link 240 as the actuating link 230 is slid relative to the corner post 200. This, in turn, prevents over-rotation of the reversing link 260 relative to the corresponding corner post 200 during folding and unfolding of the play yard 1000. It is contemplated that this functionality could be achieved with the upper and lower anti-racking pivots 402, 404 located on different components of the play yard 1000 without departing from the scope of the present disclosure. For example, in other embodiments of the present disclosure, the lower anti-racking pivot 404 may be located on the upper diagonal link 310 of the lower linkage assembly 300.

It is noted that the anti-racking link 400 needs to be provided on only one of the lower linkage assemblies 300 of the play yard 1000 to achieve the functionality discussed above. Because all of the top rails 100, corner posts 200, and lower linkage assemblies 300 of the play yard 1000 are ultimately interconnected, preventing over-rotation of the reversing links 260 associated with only one of the corner posts 200 inherently prevents over-rotation of the reversing links 260 associated with the other corner posts 200. However, in some embodiments of the present disclosure, the anti-racking link 400 may be provided on multiple or all of the lower linkage assemblies 300 associated with multiple or all of the corresponding corner posts 200.

Also shown in FIG. 4, the play yard 1000 may include one or more wheels 500 rotatably connected to the bottom of each corner post 200. The wheels 500 allow the corner posts 200 to roll along a floor surface as the play yard 1000 is transitioned from the unfolded position to the folded position and vice versa. Additionally, the wheels may assist a user in moving the play yard 1000 across the floor surface.

In the unfolded position as shown in FIGS. 3 through 5, each reversing link 260 is at a minimum rotation angle $\alpha_0$ relative to the corner post 200. As such, the lifting link pivot 262 is at its closest position relative to the corner post 200, which in turn maximizes the rotation angle $\beta_0$ of the lifting link 240 relative to the actuating link 230. Consequently, the actuating link 230 is slid to an upward-most position relative to the corner post 200.

Referring now to FIGS. 6 and 7, a top corner portion of the play yard 1000 shown in detail $B_0$ of FIG. 3 will be described in greater detail. It is noted that the perspective view of FIG. 6, for simplicity, shows only one top rail 100, including the left member 102. However, the play yard 1000 would include a second top rail connected to the corner post 200 in the same manner as the top rail 100 shown. The second top rail would be located about the longitudinal axis of the corner post 200 at an angle relative to the top rail 100 shown. For example, in the embodiment of the play yard 100 shown in FIGS. 1 and 2, the second top rail 100 would extend from the corner post 200 at a 90° angle relative to the top rail 100 shown in FIG. 6.

As shown in FIGS. 6-7, the actuating link 230 may include an upper guide roller 280 rotatably connected to the actuating link 230 and configured to roll along an upper bearing surface 206 of the corner post 200. The upper guide roller 280 may be connected to the actuating link 230 at the upper actuating link pivot 234, such that the upper actuating link pivot 234 serves as both the connection between the actuating link 230 and the locking link 220 and as a rotational axis of the upper guide roller 280. In other embodiments of the present disclosure, the upper guide roller 280 may be connected at any location along the actuating link 230 on either side of the upper actuating link pivot b.

In some embodiments of the present disclosure, as shown in FIGS. 6 and 7, the upper bearing surface 206 may include a guide pad 207 extending outwardly from the corner post 200. The guide pad 207 may include a slanted top surface 208 which serves as a lock to retain the play yard 1000 in the unfolded position and prevent unintentional transition to the folded position due to a force applied to the top rail 100. In particular, the upper guide roller 280 rests on the slanted top surface 208 with the play yard 1000 in the unfolded position. Alternatively, the upper guide roller 280 passes over the slanted top surface 208 as the play yard 1000 is transitioned to the unfolded position. In either case, the upper guide roller 280 becomes locked or trapped by the slanted top surface 208 against any downward forces imparted to the top rail 100. If a downward force FD is imparted to top rail 100, such as by a child climbing on the top rail 100, the downward force is transmitted through the locking link 220. Due to the angle of the locking link 220 relative to the top rail 100 and the corner post 200, a component of the downward force FD is redirected into a horizontal force FH acting through the upper guide roller 280 against the corner post 200. The horizontal force FH prevents the guide roller 280 from traveling back along the slanted top surface 208 of the guide pad 207.

With continued reference to FIGS. 3, 6 and 7 showing the play yard 1000 in the unfolded position, the top rail 100 is rotated relative to the corresponding corner post 200 at a maximum rotation angle $\theta_0$. As discussed above with respect to FIGS. 3 through 5, the rotational position of the reversing link 260 in the unfolded position of the play yard 1000 drives the actuating link 230 to an upward-most position relative to the corner post 200. Consequently, the actuating link 230 drives the locking link 220 upward which in turn drives the top rail 100 to the maximum rotation angle $\theta_0$.

Figure 8:
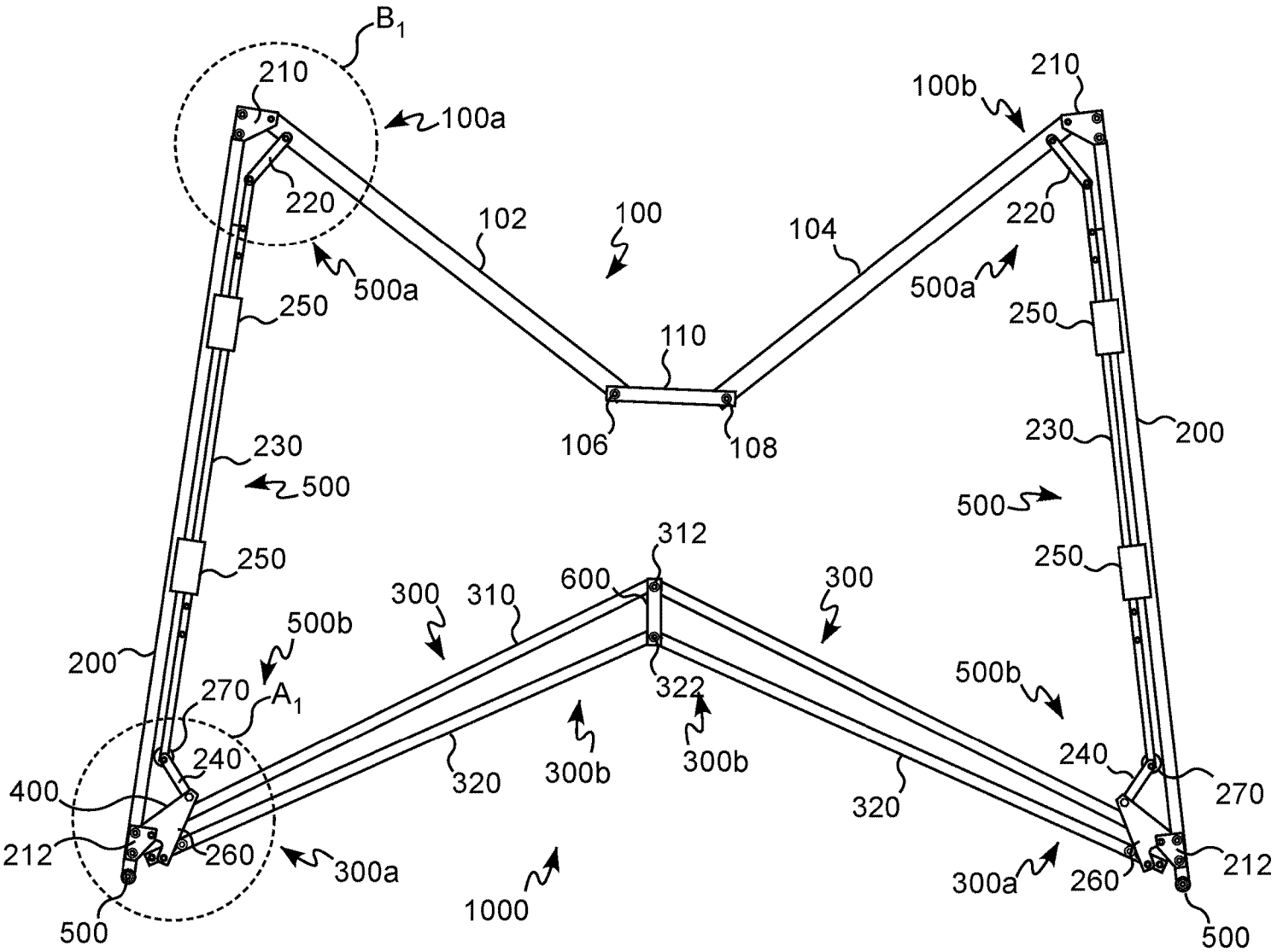
FIG. 8 is a side view of the play yard of FIG. 3, shown in a first intermediate position.
Figure 9:
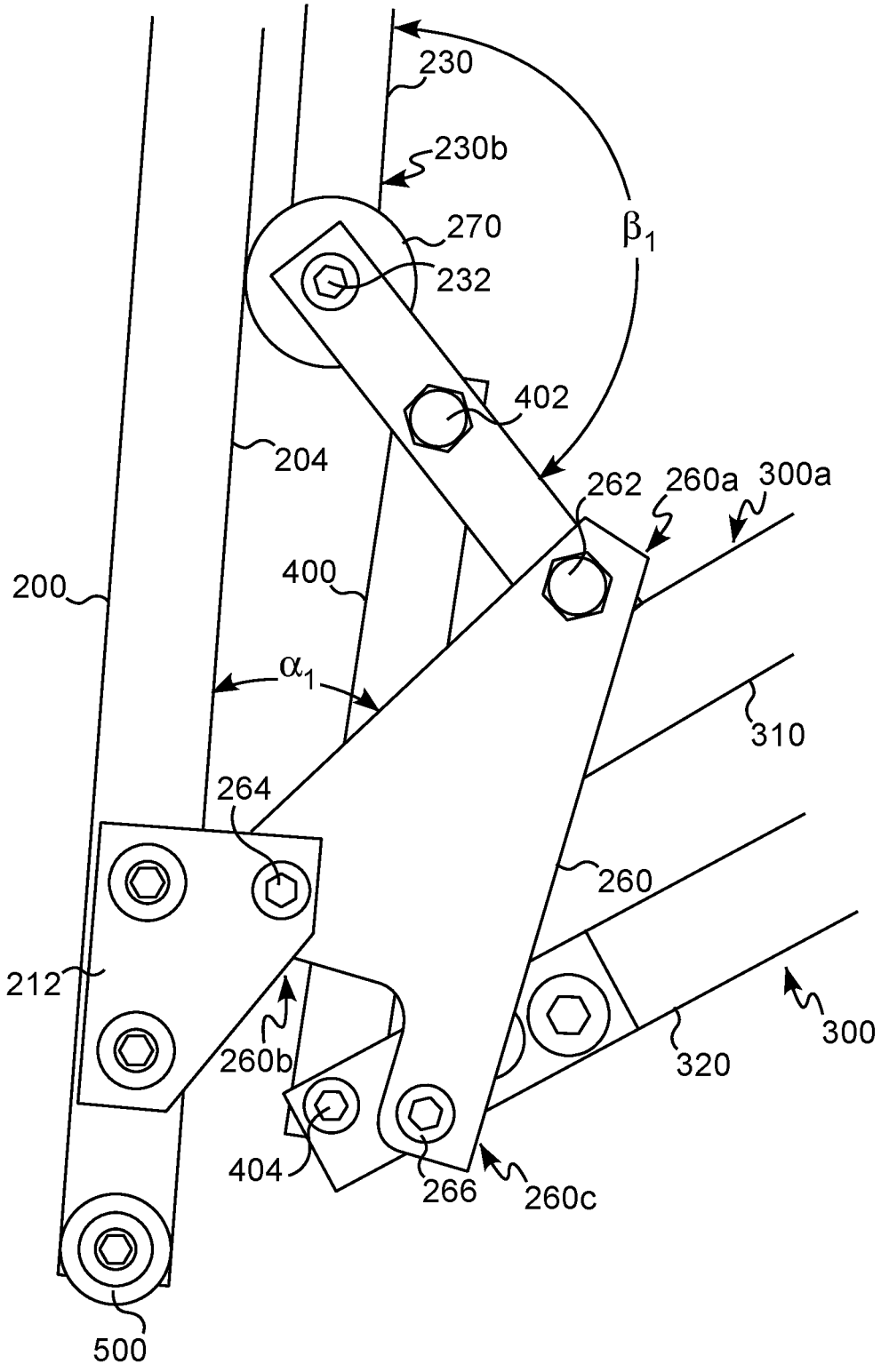
FIG. 9 is a side view of detail $A_1$ of FIG. 8, showing the foot of the play yard in the first intermediate position.
Figure 10:
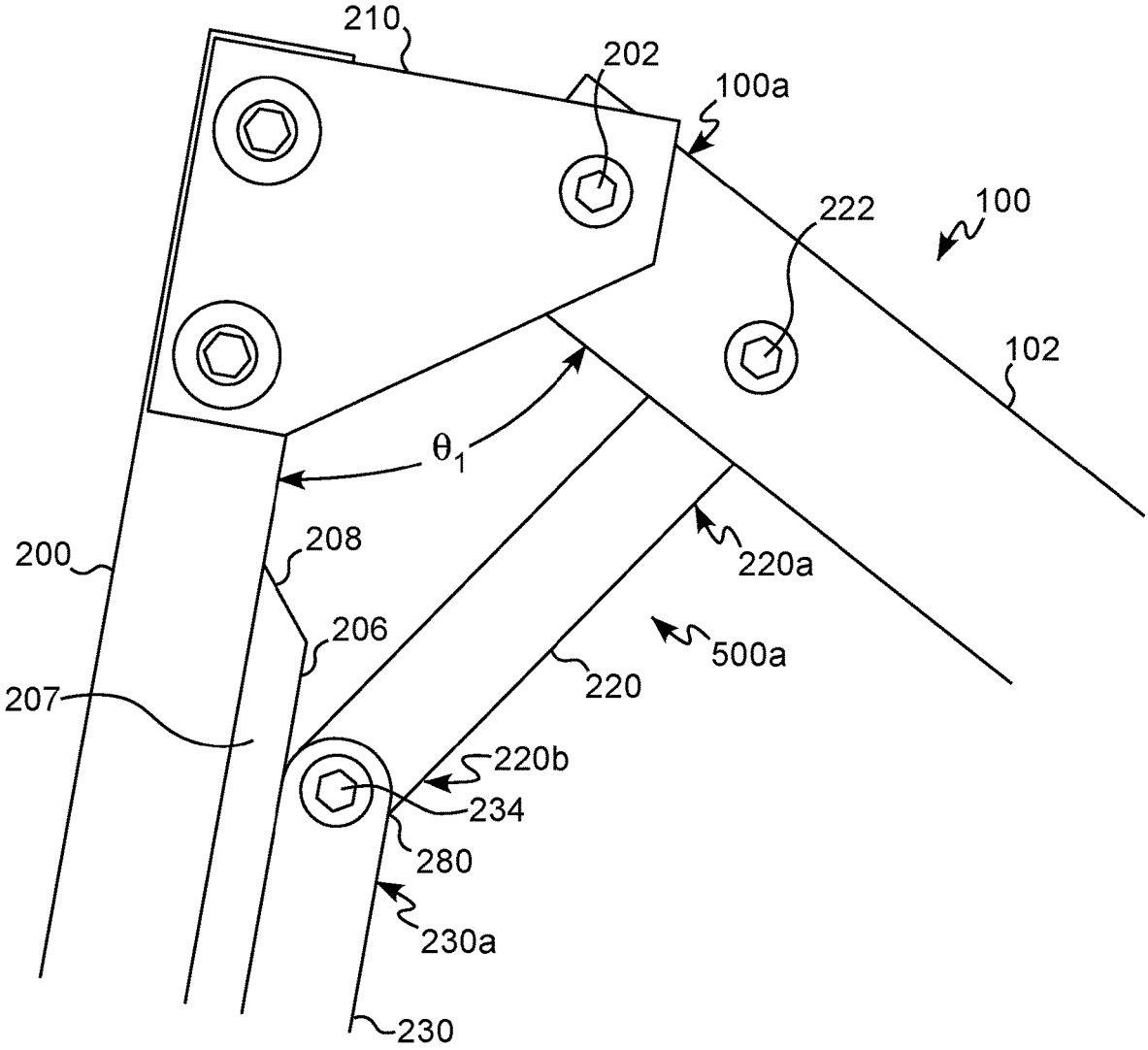
FIG. 10 is a side view of detail $B_1$ of FIG. 8, showing the upper corner of the play yard in the first intermediate position.
Figure 14:
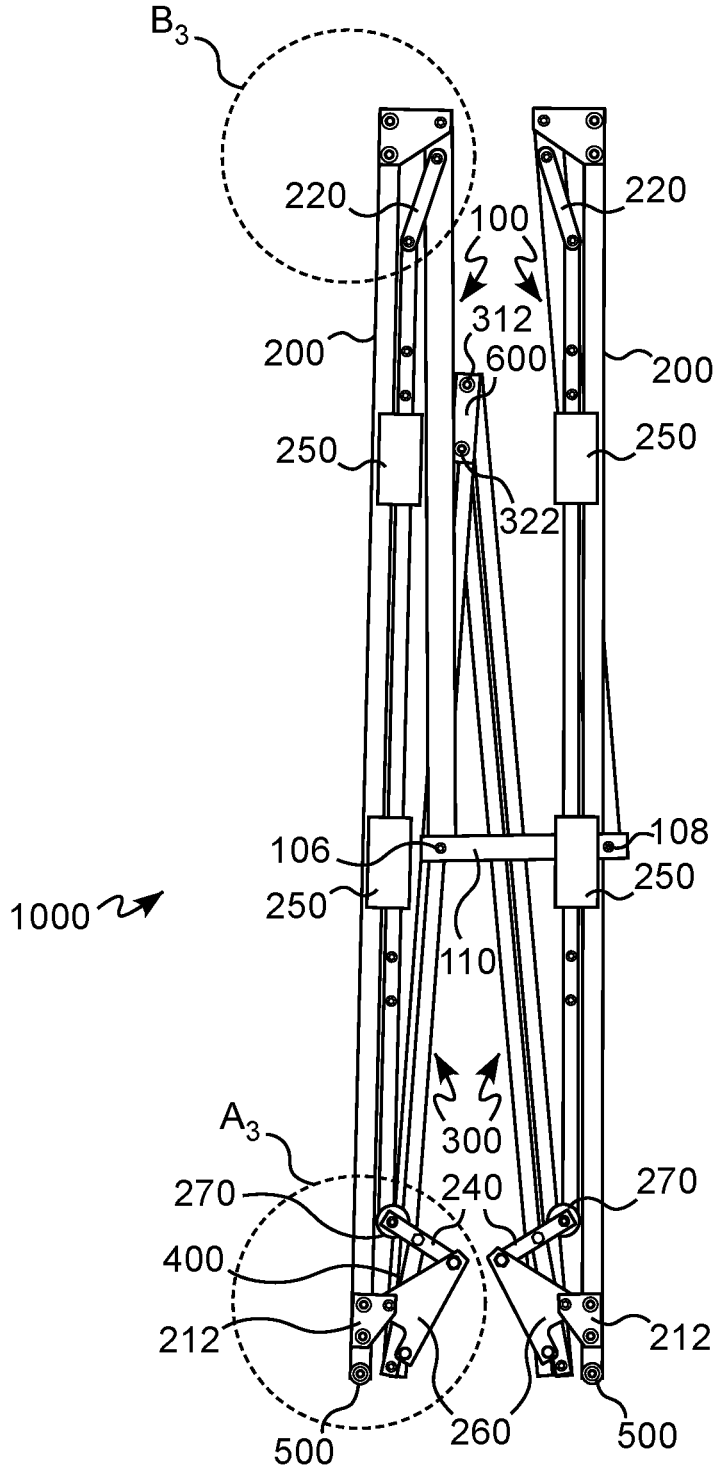
FIG. 14 is a side view of the of the play yard of FIG. 3, shown in a folded position.

Referring now to FIG. 8, one side of the play yard 1000 is shown in a first intermediate position between the unfolded position of FIG. 3 and the folded position of FIG. 14. FIG. 9 shows the foot portion of the play yard 1000 from detail Ai of FIG. 8, and FIG. 10 shows the upper corner portion of the play yard 1000 from detail $B_1$ of FIG. 8. The play yard 1000 is transitioned from the unfolded position to the first intermediate position by a user raising the central hub 600. As the central hub 600 is raised, the lower linkage assemblies 300 are rotated upward, the top rail 100 pivots about the joint member 110, and the corner posts 200 are drawing toward the central hub 600. As may be appreciated from FIG. 8, the left and right members 102, 104 of the top rails 100 may rotate freely about the pivot points 106, 108 of the joint member 110 such that the top rail 100 has multiple degrees of freedom when folding to prevent pinning a user's or child's body part under the top rail 100.

Referring now to FIGS. 8 and 9, raising the central hub 600 causes the end of the lower linkage assembly 300 connected to the central hub 600 to be raised relative to the end of the lower linkage assembly 300 connected to the reversing link 260 and the corner post 200. Due to the arrangement of the upper diagonal link 310 and the lower diagonal link 320 of the lower linkage assemblies 300, raising the central hub 600 causes the lower diagonal link 320 to push the lower link pivot 266 toward the corner post 200. As such, the reversing link 260 is rotated about the reversing link pivot 264 in a direction that moves the lower link pivot 266 toward the corner post 200 and moves the lifting link pivot 262 away from the corner post 200. In the orientation of the play yard 1000 shown in FIG. 9, the reversing link 260 is rotated in a clockwise direction relative to the position of the reversing link 260 in the unfolded position shown in FIG. 5. Accordingly, the angle ai of the reversing link 260 relative to the corner post 200 with the play yard 1000 in the first intermediate position is greater the minimum angle $\alpha_o$ of the reversing link 260 relative to the corner post 200 with the play yard 1000 in the unfolded position (as shown in FIG. 5).

As may also be appreciated from FIG. 9, rotation of the reversing link 260 occurs in the opposite direction of rotation of the lower linkage assembly 300. As noted above, the reversing link 260 is rotated in a clockwise direction when viewed in the orientation of the play yard 1000 shown in FIG. 9. In contrast, the lower linkage assembly 300, when viewed in the orientation of the play yard 1000 shown in FIG. 9, rotates about the reversing link pivot 264 in a counterclockwise direction.

With continued reference to FIG. 9, the increase in the angle $\alpha_1$ of the reversing link 260 relative to the corner post 200 pulls the lifting link pivot 262 away from the corner post 200, which in turn decreases the rotation angle $\beta_1$ of the lifting link 240 relative to the actuating link 230. Consequently, the actuating link 230 is slid downward relative to the corner post 200.

Referring now to FIG. 10, as the actuating link 230 is slid downward relative to the corresponding corner post 200, the upper guide roller 280 is pulled over the top slanted surface 208 of the guide pad 207 and out to the locked position. The locking link 220 is pulled down along with the actuating link 230 such that the left member 102 of the top rail 100 is rotated about the upper corner pivot 202. The rotation angle $\theta_1$ of the top rail 100 relative to the corner post 200 is decreased compared to the maximum angle θ° as shown in FIG. 7.

Figure 11:
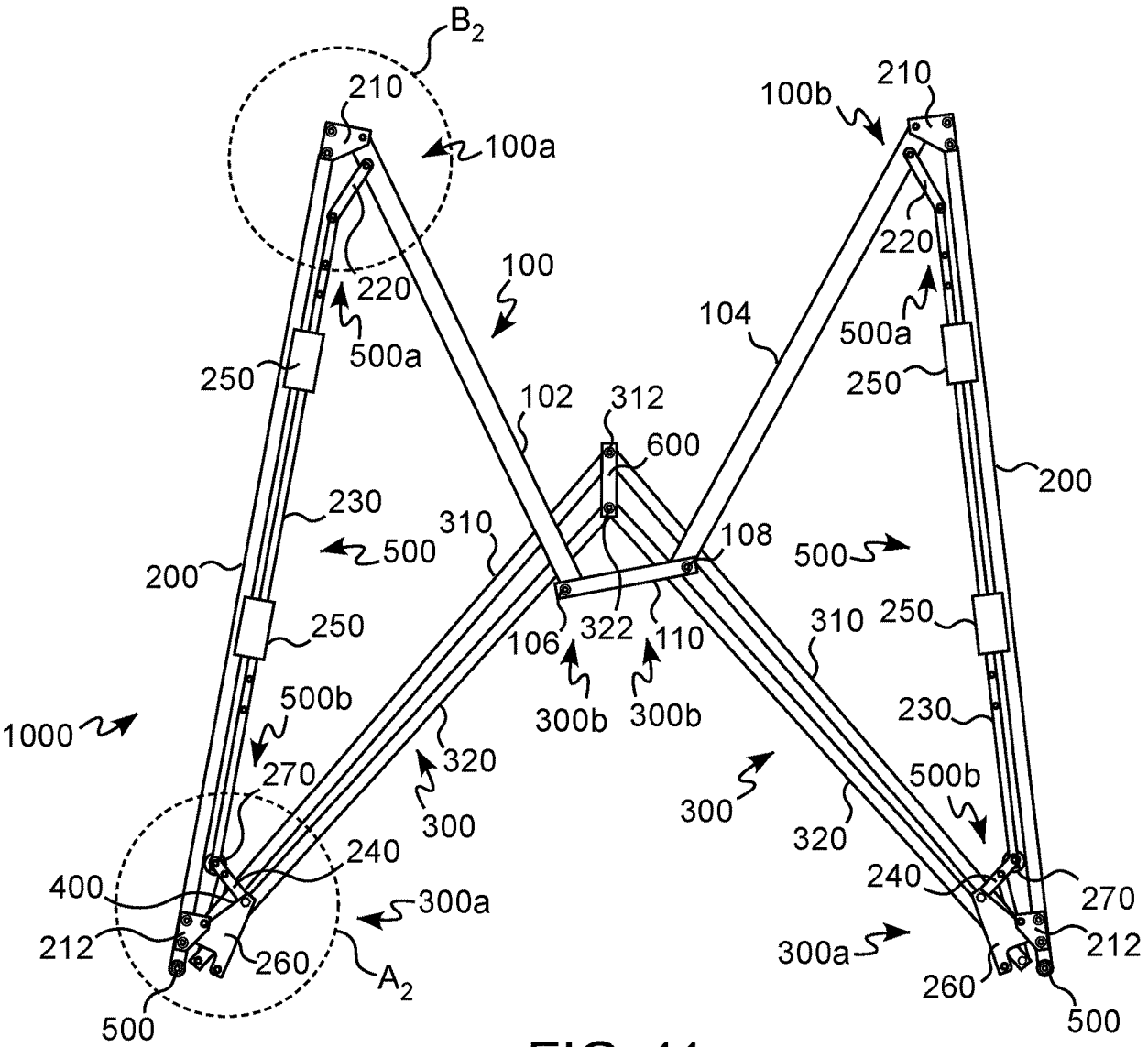
FIG. 11 is a side view of the of the play yard of FIG. 3, shown in a second intermediate position.
Figure 12:
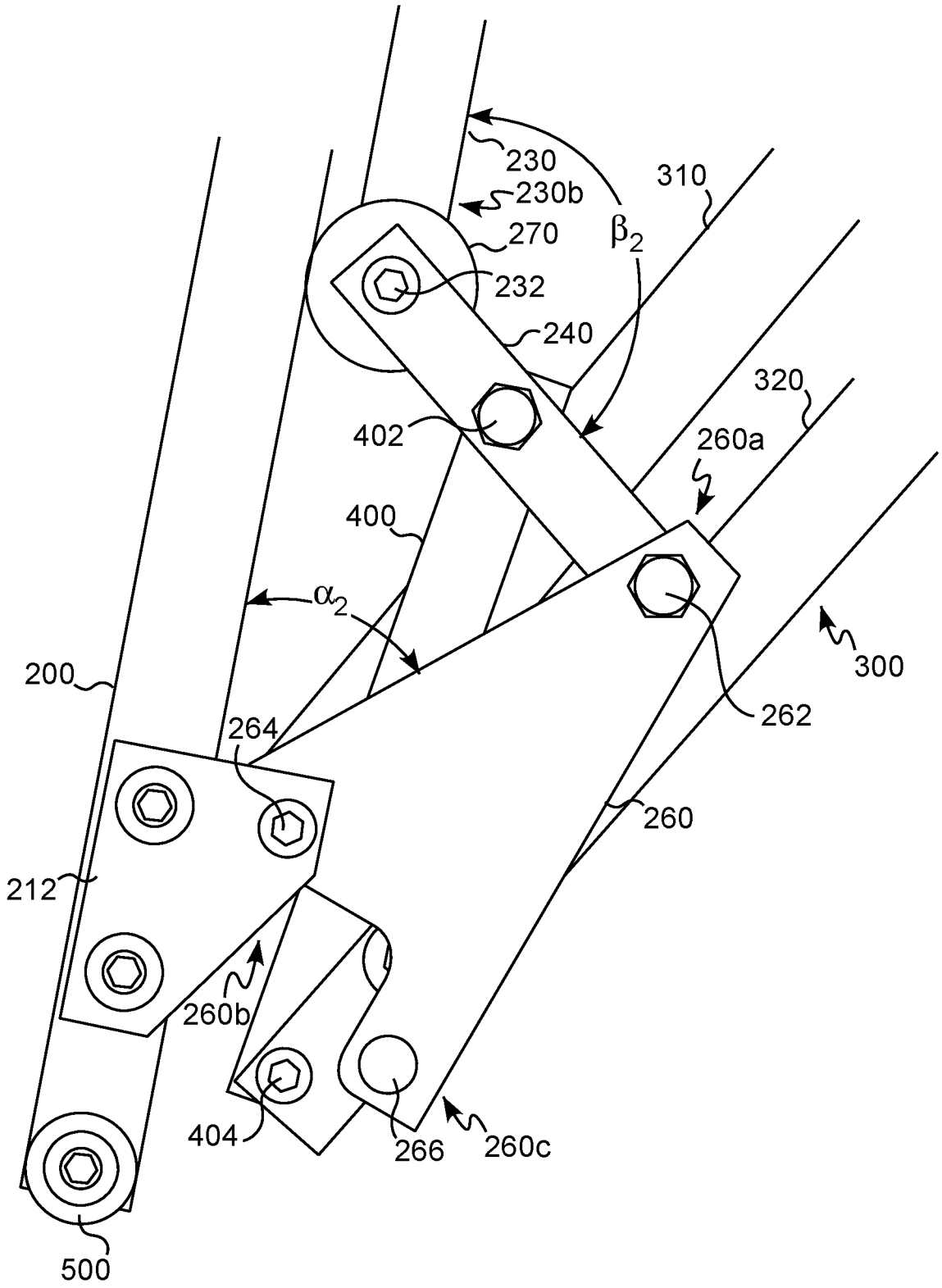
FIG. 12 is a side view of detail $A_2$ of FIG. 11, showing the foot of the play yard in the second intermediate position.
Figure 13:
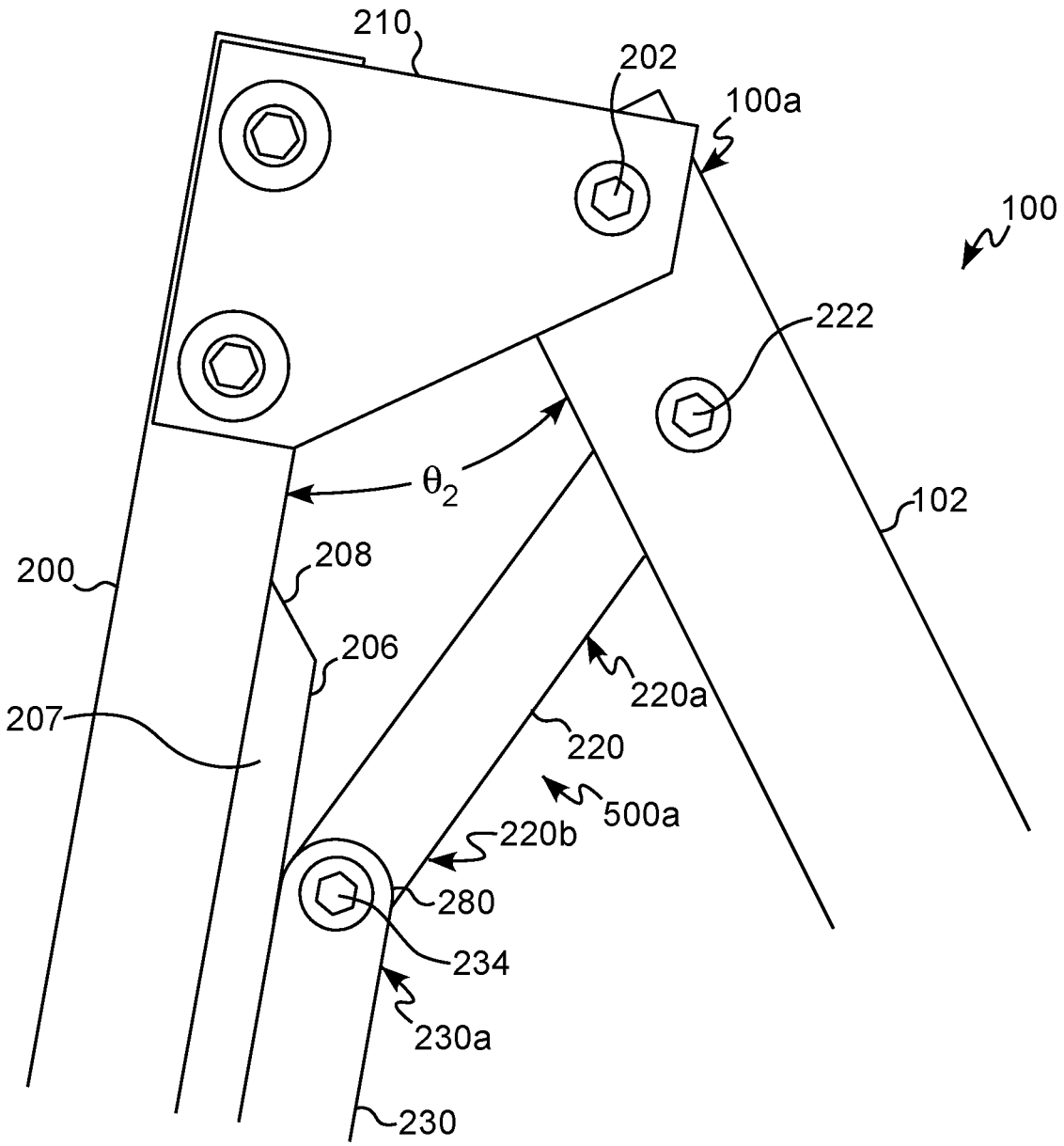
FIG. 13 is a side view of detail $B_2$ of FIG. 11, showing the upper corner of the play yard in the second intermediate position.

Referring now to FIG. 11, one side of the play yard 1000 is shown in a second intermediate position between the first intermediate position of FIG. 8 and the folded position of FIG. 14. FIG. 12 shows the foot portion of the play yard 1000 from detail $A_2$ of FIG. 11, and FIG. 13 shows the upper corner portion of the play yard 1000 from detail $B_2$ of FIG. 11. The play yard 1000 is transitioned from the first intermediate position to the second intermediate position by the user further raising the central hub 600. The action of the various components as the play yard 1000 is transitioned from the first intermediate position to the second intermediate position is generally a continuation of the action of the play yard 1000 transitioning from the unfolded position to the first intermediate position (as described above with reference to FIGS. 8 through 10). As the central hub 600 is further raised to the second intermediate position, the reversing link 260 continues to rotate about the reversing link pivot 264, increasing the rotation angle $\alpha_2$ relative to the rotation angle $\alpha_1$ of the first intermediate position. The rotation angle $\beta_2$ between the actuating link 230 and the lifting link 240 continues to decrease relative to the rotation angle $\beta_1$ of the first intermediate position. As a result, the actuating link 230 is drawn further downward relative to the corresponding corner post 200, in turn pulling the locking link 220 and top rail 100 closer to the corner post 200. Consequently, the rotation angle $\theta_2$ between the top rail 100 and the corner post 200 continues to decrease relative to the rotation angle $\theta_1$ of the first intermediate position. The corner posts 200 are therefore drawn closer to the central hub 600.

Figure 15:
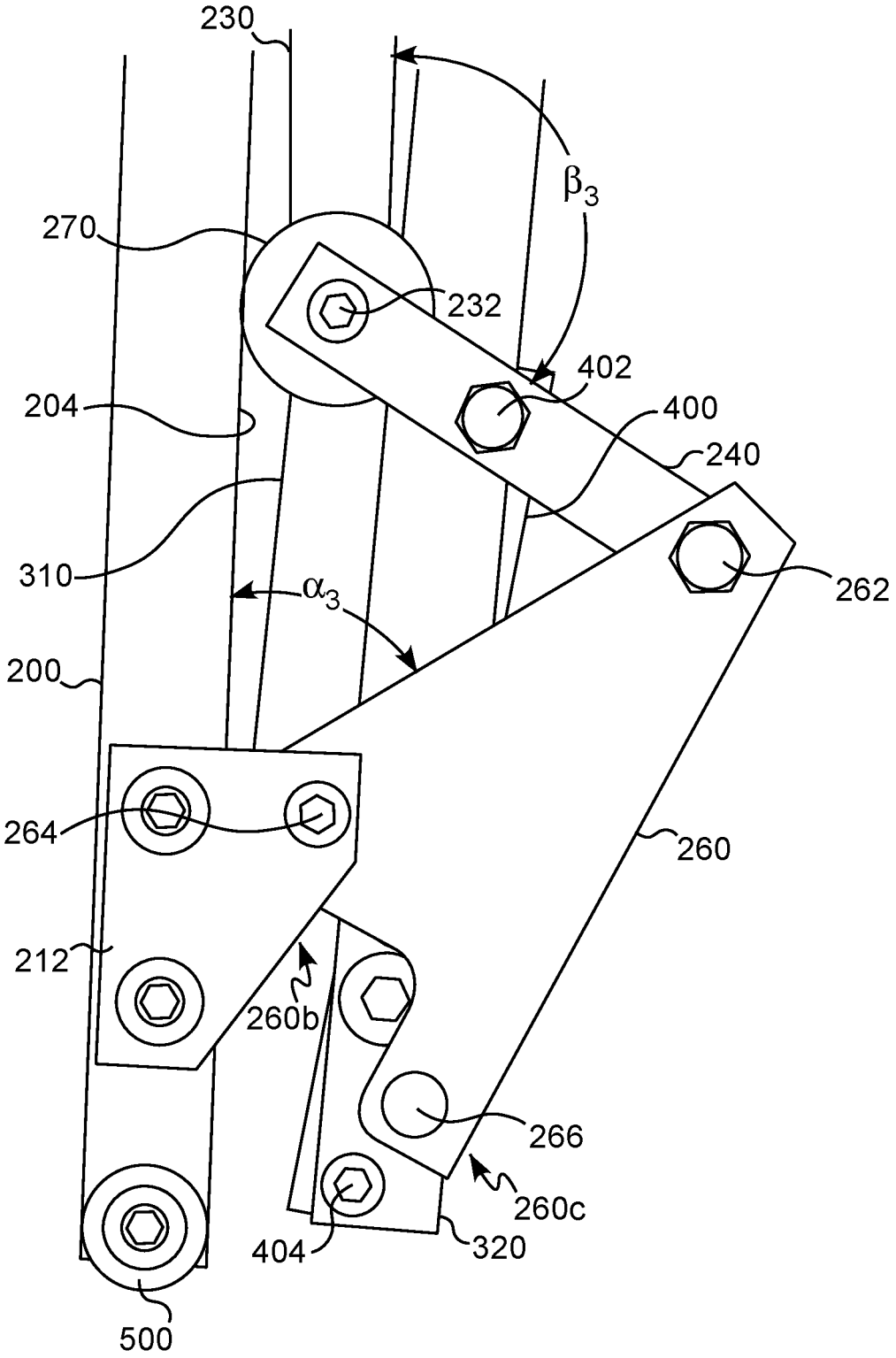
FIG. 15 is a side view of detail $A_3$ of FIG. 14, showing the foot of the play yard in the folded position.
Figure 16:
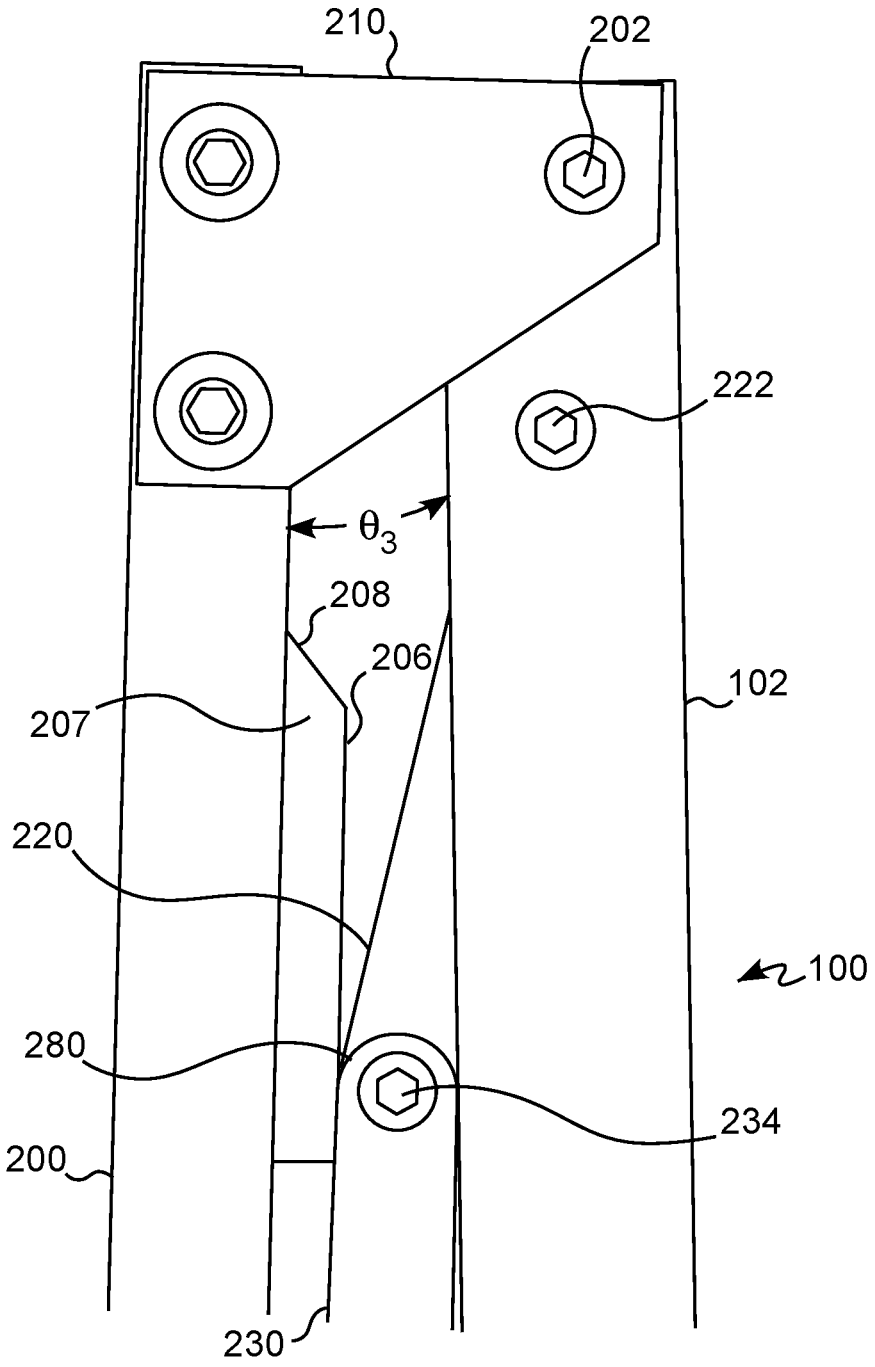
FIG. 16 is a side view of detail $B_3$ of FIG. 14, showing the upper corner of the play yard in the folded position.

Referring now to FIG. 14, one side of the play yard 1000 is shown in the folded position of FIG. 14. FIG. 15 shows the foot portion of the play yard 1000 from detail $A_3$ of FIG. 14, and FIG. 16 shows the upper corner portion of the play yard 1000 from detail $B_3$ of FIG. 14. The play yard 1000 is transitioned from the second intermediate position to the folded position by the user further raising the central hub 600. The action of the various components as the play yard 1000 is transitioned from the second intermediate position to the folded position is generally a continuation of the action of the play yard 1000 transitioning from the first intermediate position to the second intermediate position (as described above with reference to FIGS. 11-13). As the central hub 600 is further raised to the folded position, the reversing link 260 continues to rotate about the reversing plate pivot 264, increasing the rotation angle $\alpha_3$ relative to the rotation angle $\alpha_2$ of the second intermediate position. The rotation angle (33 between the actuating link 230 and the lifting link 240 continues to decrease relative to the rotation angle (32 of the second intermediate position. As a result, the actuating link 230 is drawn further downward relative to the corner post 200, in turn pulling the locking link 220 and top rail 100 closer to the corner post 200. Consequently, the rotation angle $\theta_3$ between the top rail 100 and the corner post 200 continues to decrease relative to the rotation angle $\theta_2$ of the second intermediate position. The corner posts 200 are therefore drawn closer to the central hub 600.

Throughout the movement of the various components of the play yard 1000 from the unfolded position to the first intermediate position, the second intermediate position, and ultimately the folded position, the anti-racking link 400 limits the rotation of the reversing link 260 to prevent over-rotation of the reversing link 260. As such, the lifting link pivot 262 is maintained on an inward side of the corner post 200 relative to the central hub 600, and the relative rotation between the corner posts 200 and the lower linkage assemblies 300 is limited to a range suitable for smooth folding and unfolding of the play yard 1000.

The play yard 1000 may be transitioned from the folded position of FIGS. 14 through 16 back to the unfolded position of FIGS. 3 through 7 by the user pressing down on the central hub 600. As the user presses down on the central hub 600, the action of the various components of the play yard 1000 is simply the opposite of the action described above for transitioning the play yard from the unfolded position to the folded position. In particular, as the play yard is transitioned from the folded position to the unfolded position, pressing down on the central hub 600 causes the reversing link 260 to rotate, which ultimately drives the actuating link 230 upward relative to the corresponding corner posts and locks the top rails 100 in the unfolded position.

Figure 17:
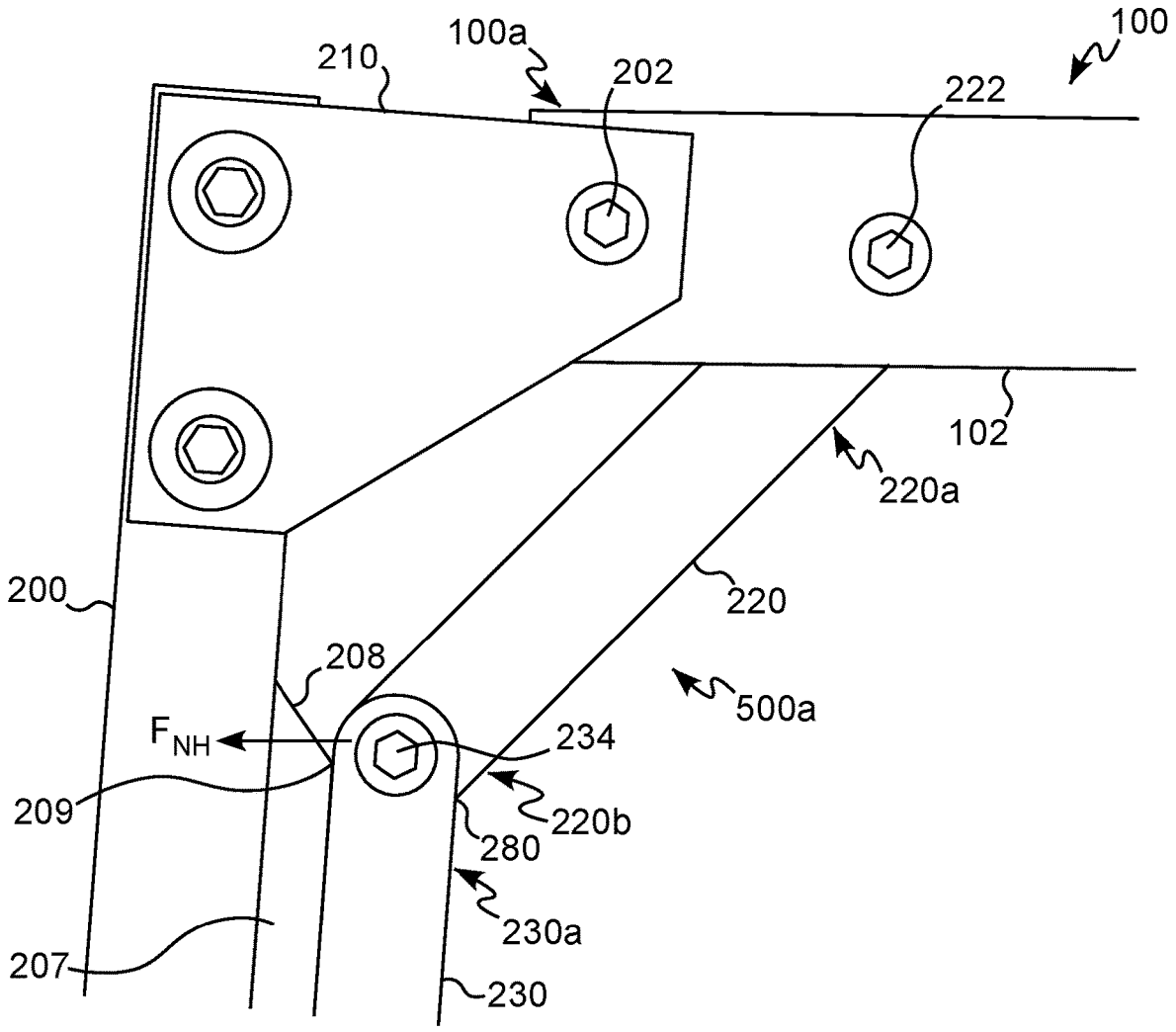
FIG. 17 is a side view of the upper corner of the play yard of FIG. 3, just before locking into the unfolded position.

Referring now to FIG. 17, an upper corner portion of the play yard 1000 is shown during the transition from the first intermediate position to the unfolded position, just prior to the upper guide roller 280 being locked into place. The upper guide roller 280 rolls along the guide pad 207 and begins to crest a corner 209 of the guide pad 207 onto the top slanted surface 208. As the actuating link 230 presses upward into the locking link 220, the locking link 220 exerts a normal force against the actuating link 230 at the upper actuating link pivot 232. A horizontal component of the normal force $F_{NH}$ presses the upper guide roller 280 against the corner post 200 and prevents the upper guide roller 280 from rolling back down the top slanted surface 208. In this manner, the actuating link 230 and the locking link 220 are retained in the unfolded position until the central hub 600 is raised to relieve the normal force exerted by the locking link 220 on the actuating link 230.

The post linkage assembly 500 has a first end 500*a* and a second end 500*b* as shown in FIG. 3. In the embodiments of the present disclosure described above, the post linkage assembly 500 includes three members, namely the locking link 220, the actuating link 230, and the lifting link 240. In other embodiments, the post linkage assembly 500 may include more or less members without departing from the scope of the present disclosure. For example, the post linkage assembly 500 may include only two members while still maintaining the functionality described above of the locking link 220, the actuating link 230, and the lifting link 240. More generally, the post linkage assembly 500 may include a combination of any number of members which is rotatably connected to the top rail 100 and rotatably connected to the reversing link 260 such that raising the central hub 600 transitions the top rail 100 toward the folded position, and lowering the central hub 600 transitions the top rail 100 toward the unfolded position.

Although the invention has been described in detail for the purpose of illustration based on what is currently considered to be the most practical and preferred embodiments, it is to be understood that such detail is solely for that purpose and that the invention is not limited to the disclosed embodiments but, on the contrary, is intended to cover modifications and equivalent arrangements. For example, it is to be understood that the present invention contemplates that to the extent possible, one or more features of any embodiment can be combined with one or more features of any other embodiment.

The invention claimed is:

1. A foldable play yard, comprising:

a plurality of corner posts;

a plurality of top rails, each top rail having two opposing ends, and each of the opposing ends of each of the plurality of top rails rotatably connected to one of the plurality of corner posts to define a polygonal shape;

a plurality of reversing links corresponding to the plurality of corner posts, with each reversing link having a first, second and third connection point, and each of the plurality of reversing links rotatably connected at the second connection point of each reversing link to the corresponding corner post;

a central hub;

a plurality of lower linkage assemblies corresponding to the reversing links, with each lower linkage assembly having a first and second end, and each of the plurality of lower linkage assemblies rotatably connected at the first end of each lower linkage assembly to the third connection point of the corresponding reversing link and, at the second end of each lower linkage assembly, rotatably connected to the central hub; and a plurality of post linkage assemblies corresponding to the reversing links, with each post linkage assembly having a first and second end, and each of the plurality of post linkage assemblies rotatably connected at the first end of each post linkage assembly to one or more of the top rails and, at the second end of each post linkage assembly, rotatably connected to the first connection point of the corresponding reversing link;

wherein lowering the central hub causes each of the lower linkage assemblies to rotate relative to the corresponding corner post in a first direction, wherein rotation of each of the lower linkage assemblies in the first direction causes each of the reversing links to rotate relative to the corresponding corner post in a second direction opposite the first direction, and wherein rotation of the reversing links in the second direction drives the post linkage assemblies to rotate the top rails relative to the corner posts.

2. The foldable play yard of claim 1, wherein each of the post linkage assemblies comprises:

a locking link having first and second ends, the first end of the locking link rotatably connected to one of the opposing ends of one of the top rails and the second end of the locking link rotatably connected to a first end of an actuating link; and a lifting link having first and second ends, the first end of the lifting link rotatably connected to a second end of the actuating link at the end of the actuating link opposite the locking link and the second end of the lifting link rotatably connected to the first connection point of one of the corresponding reversing links.

3. The foldable play yard of claim 1 or 2, further comprising an anti-racking link rotatably connected to one of the lower linkage assemblies and rotatably connected to one of the post linkage assemblies, wherein the anti-racking link limits rotation of the reversing links.

4. The foldable play yard of claim 2, further comprising an anti-racking link rotatably connected to one of the lower linkage assemblies and rotatably connected to the lifting link of one of the post linkage assemblies, wherein the anti-racking link limits rotation of the reversing links.

5. The foldable play yard of claim 2, further comprising:

an upper guide roller rotatably connected to the actuating link of each post linkage assembly and configured to roll along a guide pad of each of the corner posts, wherein the guide pad of each of the corner posts comprises a slanted top surface configured to lock the guide roller in place when the guide roller passes over the slanted top surface.

6. A folding mechanism for a foldable play yard, the foldable play yard comprising a plurality of corner posts and a plurality of top rails, each of the top rails rotatably connected to two of the plurality of corner posts to define a polygonal shape, the folding mechanism comprising:

a central hub;

a reversing link rotatably connected to the central hub via a lower linkage assembly, the reversing link rotatably connected to the corresponding corner posts;

a post linkage assembly rotatably connected to the corresponding reversing link and rotatably connected to at least one of the top rails;

wherein lowering the central hub causes the reversing link to rotate;

wherein rotation of the reversing link causes the post linkage assembly to rotate at least one of the top rails; and an anti-racking link rotatably connected to the lower linkage assembly and rotatably connected to the post linkage assembly, wherein the anti-racking link limits rotation of the reversing link.

7. A locking mechanism for a foldable play yard, the foldable play yard comprising a plurality of corner posts and a plurality of top rails, each of the top rails rotatably connected to two of the plurality of corner posts to define a polygonal shape, the locking mechanism comprising:

an actuating link slidably connected to one of the corner posts;

a locking link rotatably connected to the actuating link and rotatably connected to one of the top rails;

a guide roller rotatably connected to the actuating link; and a guide pad connected to one of the corner posts, the guide pad including a slanted top surface;

wherein the guide roller is configured to roll along the guide pad as the actuating link slides relative to the corresponding corner post, and wherein the top slanted surface of the guide pad is configured to lock the guide roller in place when the guide roller passes over the slanted top surface.

8. A foldable play yard, comprising:

a plurality of corner posts;

a plurality of top rails, each top rail having two opposing ends, and each of the opposing ends of each of the plurality of top rails rotatably connected to one of the plurality of corner posts to define a polygonal shape;

a plurality of locking links with each of the locking links having a first end and a second end, and the first end of each of the locking links rotatably connected to one of the opposing ends of one of the plurality of top rails;

a plurality of actuating links with each of the actuating links having a first end and a second end, and the first end of each of the actuating links rotatably connected to the second end of each of the locking links;

a plurality of lifting links with each lifting link having a first end and a second end, and the first end of each of the lifting links rotatably connected to the second end of each of the actuating links;

a plurality of reversing links corresponding to the plurality of corner posts, with each reversing link having a first, second and third connection point, and the first connection point of each reversing link rotatably connected to the second end of each of the lifting links and the second connection point of each reversing link rotatably connected to the corresponding corner post;

a central hub; and a plurality of lower linkage assemblies corresponding to the reversing links, with each lower linkage assembly having a first end and a second end, and the first end of each lower linkage assembly rotatably connected to the third connection point of a corresponding reversing link and the second end of each lower linkage assembly rotatably connected to the central hub;

wherein lowering the central hub causes each of the lower linkage assemblies to rotate relative to the corresponding corner post in a first direction, wherein rotation of each of the lower linkage assemblies in the first direction causes each of the reversing links to rotate relative to the corresponding corner post in a second direction opposite the first direction, and wherein rotation of the reversing links in the second direction drives the post linkage assemblies to rotate the top rails relative to the corner posts.

9. The foldable play yard of claim 8, further comprising an anti-racking link rotatably connected to one of the lower linkage assemblies and rotatably connected to one of the post linkage assemblies, wherein the anti-racking link limits rotation of the reversing links.

10. The foldable play yard of claim 8, further comprising:

an upper guide roller rotatably connected to the actuating link of each post linkage assembly and configured to roll along a guide pad of each of the corner posts, wherein the guide pad of each of the corner posts comprises a slanted top surface configured to lock the guide roller in place when the guide roller passes over the slanted top surface.

* * * * *